United States Patent [19]

Mehnert et al.

[11] Patent Number: 4,774,451

[45] Date of Patent: Sep. 27, 1988

[54] VOLTAGE CONTROLLING TRANSFORMER CIRCUIT AND METHOD FOR GENERATING A CONTROLLED LOAD VOLTAGE BY USING SUCH A TRANSFORMER CIRCUIT

[75] Inventors: Walter Mehnert, Ottobrunn; Ludwig Bölkow, Grünwald, both of Fed. Rep. of Germany

[73] Assignee: MITEC Moderne Industrietechnik GmbH, Fed. Rep. of Germany

[21] Appl. No.: 757,831

[22] Filed: Jul. 22, 1985

[30] Foreign Application Priority Data

Jul. 24, 1984 [DE] Fed. Rep. of Germany ..... 3427291
Jan. 29, 1985 [DE] Fed. Rep. of Germany ..... 3502889
Mar. 25, 1985 [DE] Fed. Rep. of Germany ..... 3511182

[51] Int. Cl.[4] ..... G05F 1/26

[52] U.S. Cl. ..... 323/263; 323/301; 323/344

[58] Field of Search ..... 323/247, 255, 258, 259, 323/263, 301, 328, 340, 343, 344, 346

[56] References Cited

U.S. PATENT DOCUMENTS 3,621,374 11/1971 Kettler ..... 323/344
3,970,918 7/1976 Cooper ..... 323/258
3,978,395 8/1976 Leanaioli ..... 323/255
4,178,539 12/1979 Crapo ..... 323/263

FOREIGN PATENT DOCUMENTS 2043971 10/1980 United Kingdom ..... 323/301

*Primary Examiner*—Patrick R. Salce

*Assistant Examiner*—Jeffrey Sterrett

*Attorney, Agent, or Firm*—Sughrue, Mion, Zinn, Macpeak & Seas

[57] ABSTRACT

A voltage controlling transformer circuit comprises a setting unit to the input terminals of which an alternating input voltage is applied and the output terminals of which provide an alternating output voltage the amplitude of which can selectively be changed. For this purpose the setting unit comprises a transformer having a first winding connecting one of the input terminals with one of the output terminals while the other input terminal and the other output terminal are directly connected by a conductor. The transformer also comprises at least one further winding the number of turns of which is greater than the number of turns of the first winding, and to which different control voltages can be applied by means of switches in order to induce in the first winding a voltage the amplitude of which is, in dependence on the winding sense of the further winding, either additionally or subtractively imposed on the amplitude of the input voltage. For switching over from one switching state into another very quickly and smoothly it is provided to close at least one of the switches which must be closed in the "new" switching state, before the first one of the switches which must be open in the "new" switching state, is opened. To prevent impermissible high currents occuring during these switching-over operations current limiting circuits are provided in the current paths leading from the control voltage source through the respective further winding and therefrom back to the control voltage source.

41 Claims, 7 Drawing Sheets

VOLTAGE CONTROLLING TRANSFORMER CIRCUIT AND METHOD FOR GENERATING A CONTROLLED LOAD VOLTAGE BY USING SUCH A TRANSFORMER CIRCUIT

FIELD OF THE INVENTION

The invention concerns a voltage controlling transformer circuit and a method for generating a controlled load voltage by using such a transformer circuit.

Transformer circuits of that kind having at least one setting unit, which can be brought into different switching states can be used, to vary the amplitude of an alternating supply voltage delivered by a voltage source, if required, before it is applied as alternating load voltage to a load.

BACKGROUND OF THE INVENTION

A transformer circuit of that kind is for example known from the DE-OS No. 25 00 065. This circuit comprises a single setting unit with a transformer, the primary winding of which is fed by the supply voltage delivered from the voltage source. Provided at the secondary winding are several taps which can selectably be connected with the conductors leading to the load with the aid of automatically controllable switches. Hereby, it is made certain that the same alternating voltage amplitude is always conducted to the load even when the circuit is connected to voltage sources which in respect of the amplitude deliver different alternating voltages.

This known arrangement however displays a series of disadvantages. Thus, the entire power conducted to the load must be transmitted by way of the magnetic field of the transformer. The dimensioning of the transformer must therefore be adapted to this total load and correspondingly high losses result. If the load takes up a very high power, then the transformer must also be designed to be very large and beyond that cooled, which leads to appreciable manufacturing and operating costs. Beyond that, the known circuit is not suitable to switch over frequently and rapidly in order to keep the load voltage at least nearly constant in spite of corresponding changes in the amplitude of the supply voltage. If one were to operate the known arrangement in this manner, appreciable problems would also arise out of the fact that the entire power conducted to the load flows through the change-over switches. These switches would have to be operated under load on the one hand and special measures would have to be taken on the other hand in order to prevent that it comes to interruptions in the energy supply to the load during the switching-over.

Furthermore, voltage controlling transformer circuits are known which have at least one setting unit comprising two input terminals to which an alternating input voltage is applied, two output terminals delivering a controllable alternating output voltage, a transformer having a first winding which is connected to a first one of said two input terminals and a first one of said two output terminals, and a further winding the number of turns of which is greater than the number of turns of said first winding, a terminal connection conductor galvanically connecting the second one of said two input terminals with the second one of said output terminals, and switches by means of which at least one and usually several different control voltages can be applied to said at least one further winding so that in said first winding a voltage is induced which, in dependence on the winding sense of said further winding with respect to said first winding, is either additionally or subtractively imposed on the alternating input voltage of the at least one stage. As a consequence, the alternating output voltage of this stage is either equal to the sum of or equal to the difference between the alternating input voltage and the voltage induced in the first winding. This is based on the consideration that the required change in the amplitude of the supply voltage delivered from the voltage source in many cases of application amounts to only a comparatively small percentage, for example of ±25% of the amplitude. Therefore, the main part of the power is conducted to the load in galvanic manner by way of the first winding of the transformer, wherein due to the low number of turns of this winding and the low frequencies, at which high powers are delivered to loads, the inductance of this first winding produces only a very small voltage drop with correspondingly small losses.

By applying a control voltage $U_S$ to said further winding, the at least one setting unit of the transformer circuit can be brought into at least one switching state, in which a voltage $\Delta U_1$ is induced in the first winding of the transformer, which voltage in accordance with the winding sense of the further winding with respect to the first winding is either added to or subtracted from the input voltage so that it applies for the output voltage $U_A$ varied relative to the input voltage:

$$U_A = U_E \pm \Delta U_1 \quad (1)$$

In that case, the relative magnitude of $\Delta U_1$ with respect to the control voltage $U_S$ is given by the turns ratio $w_1/w_w$ of the first winding of the transformer to the further winding:

$$\Delta U_1 = (w_1/w_w) \cdot U_S \quad (2)$$

The turns ratio $w_1/w_w$ is here substantially smaller than 1 and lies in the range of 1:7 to 1:200. Beyond that, the current, which flows through the further winding in the first switching state, is to be so matched to the nominal load current, which flows through the first winding of the transformer, that the flux linkages of both windings are in terms of amount about equally great for a given turns ratio and display such an angular displacement each realtive to the other that the magnetic flux, which hereby results in the transformer core, leads to the desired induced additive or subtractive voltage drop $\Delta U_1$ across the first winding of the transformer. It is evident that the induced voltage drop $\Delta U_1$ on these presumptions is largely independent of the load current so that a constant difference between input voltage and output voltage of the setting unit can be maintained even when the load current fluctuates relative to its nominal value.

A substantial advantage of this arrangement is that merely the small part of the load, which is required for the induced amplitude change, passes by way of the magnetic coupling of the transformer. Thereby, the energy losses, which arise through the inductive energy transmission from one transformer winding to the other, are reduced to a quite appreciable degree. Thus, the transformer can be dimensioned to be correspondingly smaller and the effort, which is required for the cooling of the transformer, can be reduced. Only a small part of the total load also goes by way of the switches, with the aid of which the control voltage can be applied to the further winding of the transformer so that the switches are stressed far less even in the case of frequent switching operations. Beyond that, semi-conductor switches, for example triacs or switches being composed of V-MOS-transistors, which make possible an appreciably more rapid switching than mechanical switches, can be used even for very large loads. A complete interruption of the energy supply to the load during switching can in principle not arise, since the galvanic connection between load and voltage source remains maintained permanently by way of the first winding of the transformer.

If one applies no control voltage to the further winding of the transformer when the control unit is not disposed in the first switching state defined above, then—if further measures are not taken—the entire magnetisation of the transformer core is effected by the flux linkages of the first winding. This leads to the occurrence of a voltage drop across the first winding dependent on the magnitude of these flux linkages and thereby on the magnitude of the load current. This voltage drop, which occurs when the further winding is switched off, lets itself be used pin-pointedly as constant difference between alternating input voltage and alternating output voltage of the setting unit only in such cases of application, in which the load current is constant. Otherwise, this throttle effect of the first winding can be employed on the occurrence of a short-circuit at or in the load to limit the then flowing load short-circuit current to an uncritical amount.

For a universal usability of such a setting unit, it is expedient to take care that the magnetisation of the transformer core is not effected solely substantially by the flux linkages of the first winding also in the time spans, in which the setting unit is not disposed in the first switching state. This can for example take place through an auxiliary winding, which in the time spans, in which the further winding does not lie at a control voltage, is for example short-circuited with the aid of switches.

Through appropriate dimensioning of the number of turns and of the current which then flows through the auxiliary winding, the flux linkages of this auxiliary winding can be so set that no noteworthy induced voltage drop occurs across the first winding.

Thus, the output voltage of the setting unit is about equal to the input voltage in the time spans, in which the auxiliary winding is short-circuited. However, this equality can be attained only approximately and the apparatus effort required for this is comparatively great.

However, the at least one setting unit of the transformer circuit can be brought into different switching states by applying different control voltages to one or several further windings; this will be explained in the following for different embodiments:

When one designates the switching state, into which such a setting unit having one single further winding to which two control voltages may be applied is brought by applying a first control voltage $U_{S1}$, as first switching state which is represented by above equations (1) and (2), then, by applying a second control voltage $U_{S2}$ to the same further winding, under the same presumptions as above, a second switching state is obtained, in which a defined second voltage drop $\Delta U_2$, which is largely independent of the load current, is induced at the first winding. In this case, it is valid for the output voltage $U_A$:

$$U_A = U_E \pm \Delta U_2 \tag{3}$$

In that case, $\Delta U_2$ likewise depends on the control voltage $U_{S2}$ according to the above equation (2).

As control voltages the input voltage $U_E$ and the output voltage $U_A$ of the setting unit can be used, to which voltages the further winding is galvanically so connected directly with the aid of the switches while observing the winding sense that the one induced voltage $\Delta U_1$ is added to the input voltage and the other induced voltage $\Delta U_2$ is subtracted from the input voltage $U_E$.

Thus, it is true for the output voltage $U_A$ in the first switching state $$U_A = U_E + \Delta U_1 \tag{4}$$

and in the second switching state $$U_{A2} = U_E - \Delta U_2 \tag{5}$$

However, both these induceable voltages $\Delta U_1$ and $\Delta U_2$ can not be chosen each independently of the other. Rather, they are interlinked each with the other according to the equations $$\Delta U_1 = (w_1/w_w) \cdot U_E \tag{6}$$

and $$-\Delta U_2 = \frac{w_1}{w_1 + w_w} \cdot U_E \tag{7}$$

when $w_1$ is the number of turns of the first winding and $w_w$ is the number of turns of the further winding of the transformer.

In order that also an unchanged transmission of the amplitude of the input voltage of the setting unit is possible to the output terminals of the setting unit, the setting unit can furthermore be brought into a third switching state, in which no voltage is induced in the first winding of the transformer. In order that the first winding in this third switching state does not develop any choke effect with a correspondingly high voltage drop, care must in that case be taken that the magnetisation of the transformer core is not effected substantially through the flux linkages of the first winding alone.

This can be done in different ways as will be explained in detail below. The only important fact is, that in this third switching state, only an extremely small voltage drops across the first winding of the transformer so that the output voltage of the setting unit is to a good approximation equal to the input voltage:

$$U_{A3} = U_E \tag{8}$$

A first way for realizing the third switching state is to provide a switch, with the aid of which the further winding can be short-circuited, while it is at the same time separated from all control voltages.

Because of the small voltage drop across the first winding, only a small voltage is also induced in the further winding so that the short-circuit current flowing in the current circuit of the further winding remains small and causes only very small power losses.

In order not to overload the transformer it must be guaranteed that the short-circuit switch is closed only whilst the switches, which serve for applying a control voltage, are open. Also care must be taken that the switches which serve for applying the one control voltage are closed only, whilst the switches which serve for applying the other control voltage are open and vice versa.

In order to make a simultaneous closing of these switches impossible, the switching state of each switch can be monitored with the aid of an associated sensor unit and a closing command for a previously open switch can be suppressed by a blocking circuit when the output signal of the sensor unit of the other switch indicates that one of these other switches is still closed.

It is desirable that the output voltage $U_A$ of the setting unit during the switching-over from one switching state into the other passes as rapidly and as "smoothly" as possible, i.e. without strong upward or downward fluctuations of the absolute amplitude amount of the alternating output voltage, from its old to the new amplitude value. However, with an embodiment in which the third switching state is obtained by short-circuiting the further winding, this cannot be done in an optical way since for the closing and opening of the switches certain switching criteria must be observed, which make it impossible to switch over from one amplitude value of the output voltage to another so rapidly that the new amplitude value is attained stably after less than a full oscillation period of the alternating load voltage.

Basically it is possible to obtain the third switching state by electrically connecting in parallel the further winding of the transformer with the first winding.

Thereby, one obtains a short-circuited transformer in this third switching state with two windings, which are wound in parallel opposition on the core of the transformer and lie electrically parallel each to the other at the same voltage. The currents, which in that case flow in both the parallelly opposed windings, each try to build up a magnetic field in the core of the transformer; these fields are however directed each against the other and substantially cancel mutually. The stray inductance and the ohmic resistance of the first winding flowed through by the load current are very small. Thereby, the voltage drop arising across it is very small and above equation (8) applies to a good approximation.

The current flowing through the further winding is also correspondingly small, since the further winding possesses a substantially greater impedance than the first winding of the transformer. Hereby, the load current thus flows practically exclusively through this first winding.

In principle, four switches suffice for a transformer which possesses only a single further winding in order to be able to bring the setting unit concerned into the named three different switching states.

If no further measures are taken, it must in this case also be observed with care that the input voltage and/or the output voltage of the setting unit is not short-circuited by simultaneous closure of corresponding switches, causing the flow of an impermissibly high short-circuit current. This however means that certain switching criteria are to be observed for the opening and closing of the switches, which criteria delay the attainment of the new amplitude value on the transition from one switching state into another.

SUMMARY OF THE INVENTION

It is therefore an object of the invention to provide a transformer circuit of the type mentioned above, i.e. having one further winding, which allows to switch over from any one of the mentioned switching states to any other one thereof as quickly as possible.

This object is obtained by using one or more current-limiting circuits preventing the flow of impermissible high short-circuit currents even if at least some of the switches, which are to be closed in a "new" switching state, are closed before all of the switches, which were closed in the "old" switching state, are opened.

For a transformer comprising only a single further winding, the third and the fourth switch, i.e. both the switches, by which both the ends of the further winding are connectable with the terminal connection conductor of the setting unit, are for example themselves each constructed as current limiting circuits in the manner that they let through no current at all in the opened state and put only a very small, constant resistance against the current flowing through them in the closed state as long as this current remains below a predetermined limit value, but prevent a rising of the current beyond this limit value.

The transition from the first into the second switching state or from the second into the first switching state then simply takes place in the manner that initially also both the switches, which were open in the previous switching state, are closed, which corresponds to a transition into the third switching state, and that only thereafter the switches are opened, which must be opened in the new switching state. By reason of their current-limiting properties, the third and the fourth switch in that case prevent that impermissibly high short-circuit currents flow in the third switching state.

Another possibility for a transformer with a single further winding consists in that the third and the fourth switch, i.e. both the switches, by which both the ends of the further winding are connectible with the terminal connection conductor of the second unit, do not lead directly to this terminal connection conductor. Instead thereof, the third and the fourth switch are directly galvanically conductively connected each with the other through a further conductor and a circuit arrangement is provided between this further conductor and the terminal connection conductor, which arrangement on the one hand connects both the conductors electrically conductively each with the other and on the other hand prevents the flowing of an impermissibly large current from one of both these conductors to the other. This circuit arrangement can in the simplest case be a switch which is always opened when the setting unit shall be brought into its third switching state, in which otherwise an impermissibly high short-circuit current would flow by way of this switch. However, such switches can be opened only at quite particular instants so that the optimum switch-over speed is not yet attainable herewith.

Instead thereof, an automatically operating current-limiting circuit is preferably used here as circuit arrangement which opposes the current flowing through it by only a very small constant resistance as long as this current is smaller than a predetermined limit value. If the current however approaches this limit value too closely, then the current-limiting circuit increases its resistance in steady manner so that the current can not exceed the predetermined limit value. By contrast to a simple switch, which on opening limits the current flowing through it suddenly to the value zero, this steady limiting process has the advantage that no voltage peaks arise during it in the output voltage of the setting unit. The limit value is so chosen that it is only little greater than that current which must in the first or the second switching state flow through the further winding and also by way of the current-limiting circuit which in both these switching states lies in series with the further winding.

Since the further conductor, which connects the third and the fourth switch each with the other, would in this arrangement short-circuit the further winding when the third and fourth switch are closed at the same time, the transition from the first into the second switching state is here preferably so performed that initially the second switch is closed, which connects the second end of the further winding with the output end of the first winding. Since the first switch, which connects the first end of the further winding with the input end of the further winding, is closed in the first switching state and since this first switch initially remains closed, both the windings thus temporarily lie electrically in parallel each to the other and the setting unit is disposed in the third switching state. In that case, the current-limiting circuit prevents that an impermissibly high short-circuit current flows by way of the closed second switch and the likewise still closed fourth switch, which connects the second end of the further winding with the further conductor and thereby also with the terminal connection conductor. The switch-over operation is then continued in the manner that the fourth switch is opened and thereafter the third switch closed, which connects the first end of the further winding with the further conductor. The setting unit is disposed in the third switching state also in the case of this switch setting, since the first and the second switch are always still closed. An impermissibly high short-circuit current could now flow by way of the first and the third switch, which is however again prevented by the current-limiting circuit. Finally, the first switch is then opened so that the setting unit passes over into the second switching state.

The corresponding applies also for the switching-over from the second into the first switching state.

If the switching unit is to be held in the third switching state not transitionally, but for a longer time, then the current-limiting circuit can advantageously be so constructed that it can be switched over to at least a second current-limiting value which is substantially lower than the first current-limiting value, preferably equal to zero. In this manner, the further winding, which lies in parallel to the first winding of the transformer, is then practically completely separated from the input voltage $U_E$ and no short-circuit current at all flows any longer to the terminal connection conductor.

An automatically operating current-limiting circuit has the advantage compared with a switch, apart from the already mentioned avoidance of switching peaks, that it prevents without any delay that the current flowing through it exceeds the predetermined limit value.

According to a particularly preferred embodiment, it is provided that the limit value, to which the current-limiting circuit limits the current flowing through it, can not only be switched to and fro between two values, but be varied continuously in a predetermined range. Thereby, it is possible on the one hand to limit the short-circuit current flowing in the third switching state to a non-critical value and on the other hand in a required case to control or to regulate the currents which flow through the further winding concerned in the first or the second switching state.

If triacs, which can as is known be closed at any desired instants, but be opened only during the zero transition of the current flowing through them, are used as switches, then no particular further criteria in respect of the switching instants need be observed in the case of the above described switch-over operations.

The following temporal courses result for the switch-over of the different embodiments of setting units according to the invention and having a transformer with one single further winding.

If a setting unit comprises a transformer with a single further winding and four switches, of which the first and the second are constructed as triac and the third and the fourth as current-limiting circuit, then during the switching-over from the first (second) into the second (first) switching state, the switches which are open up to the start of switching, i.e. the second (first) and third (fourth) switch can be closed at once and without any delay, whereby the setting unit passes over into the third switching state. In order to get from this into the second (first) switching state, the first (second) and fourth (third) switch must be opened. Since it is assumed here that the first (second) switch is a triac, this is possible only when the short-circuit current flowing through it and the further winding displays a zero transition. This leads to a time delay which in the most unfavourable case can amount to half a period of the alternating current. This applies in the same manner when the setting unit passes for a short time through the third switching state not only during the transition from the first into the second or from the second into the first switching state, but has been disposed for a longer time in the third switching state and shall be brought from this into the first or second switching state.

The following effect also occurs during all these transitions whenever the third switching state is left: After the opening of the switches, a current flows in the first or the second switching state through the further winding then lying at its control voltage, which current is driven from a quite different voltage source than the short-circuit current, namely from the input voltage of the setting unit in the first switching state and from the output voltage of the setting unit in the second switching state; this current is displaced in phase relative to the short-circuit current flowing before the opening of the switches in dependence on the load current, i.e. both these currents are as a rule not equal in phase. Thus, on the use of triacs, a strong change in the current flowing through the further winding then lying at the control voltage occurs during the transition from the third into the second or the first switching state, which makes itself noticeable in the output voltage of the setting unit by a voltage peak on the first half wave following the opening of the switch concerned. Only the second following half wave then possesses the exact new amplitude value and no longer displays any overswings or voltage peaks.

In all these switch-over processes, a total switch-over duration, which is too long for certain cases of application, can thus result in conjunction with the above-mentioned waiting time up to the occurrence of the next zero transition of the short-circuit current.

Still somewhat less favourable is the situation in a setting unit, in which the transformer displays a single further winding and in which all four switches are constructed as triacs. As already described above, during the transition from the first (second) switching state into the second (first) switching state, both the switches, which are open up to the start of the switch-over operation, namely the second (first) and the third (fourth) switch may here not be closed at the same time. Rather, initially only the second (first) switch may be closed here; then, the fourth (third) switch must be opened, which on the use of triacs is possible only during the next zero transition of the current flowing through this switch. With a certain safety time spacing, the third (fourth) switch can then be closed and it is possible only thereafter to open the first (second) switch, for which a current zero transition must again be awaited. During the switching-over from the first into the second switching state or conversely, a waiting time of two half periods can thus result in the most unfavourable case. If the setting unit is held in the third switching state for a longer time, then the third and fourth switch can be opened. If a transition is then to take place into the first (or second) switching state, then initially the fourth (third) switch must initially be closed, which can occur at any time; hereupon, the second (first) switch is then opened, for which a current zero transition must again be awaited.

Since the short-circuit current and the current, which in the new switching state flows through the further winding, is also in these cases as a rule displaced in phase one relative to the other, the above described voltage peak again occurs on the first half wave of the output voltage, which follows on the last switching step of the entire switch-over operation. Total switch-over times thus result, which on the transition from the third into the first or the second switching state are exactly as long as for the first embodiment of a setting unit according to the invention and which on the transition from the first into the second or from the second into the first switching state are even still longer.

If one wants to make the switching-over operations still more rapid in these embodiments, then it is preferred instead of triacs to use electronic switches which can not only be closed, but also again opened at any desired instants. For this, for example, V-MOS transistors offer themselves, of which two must each time be connected with their source drain paths in series in opposite polarity in order to build up an alternating voltage switch. With these switches, the waiting times up to the next current zero transition are eliminated during the opening. Beyond that, for those opening operations, which each time lead from the third switching state into the first or the second switching state, a switching criterion, which is independent of the zero transition of the short-circuit current can be used, which leads to a smallest possible change in the current in the further wind-in lying at its control voltage after the switching-over operation. If one for example uses that instant as switching instant, in which the current, which after the switching-over operation flows through the further winding lying at its control voltage, possesses its zero transition, then it lets itself be attained that the output voltage of the setting unit without voltage peaks or voltage collapses possesses exactly the new amplitude value already during the first half wave which follows on this switching operation.

Since a different current flows through the further winding in the time interval, in which the setting unit is disposed in the third switching state, than when the further winding lies at its control voltage in the new switching state, according to the invention, the time spacing of the zero transition of the last named current from the zero transition of the alternating input voltage at an earlier instant is measured and stored, in which instant the setting unit is disposed in the switching state concerned. With the aid of this stored value, the above mentioned favourable switching instant can be determined starting from a zero transition of the alternating input voltage.

Thereby, in all three embodiments, the times thus let themselves be shortened appreciably, which elapse between the initiation of a switching-over operation and the instant, in which the output voltage has attained its new amplitude value stably, i.e. without imposed voltage peaks or voltage collapses. If the setting unit is disposed in the first or in the second switching state and a switching-over into the second or the first switching state becomes necessary, then in the case of the embodiments equipped with V-MOS transistors as switches, the first half of the change occurring in this case in the output voltage lets itself be performed at once at any desired instant and the second half of this change within half a period of the alternating voltage to be switched.

Such a change in or influencing of the output voltage in two very rapidly succeeding steps is extra-ordinarily advantageous, because the system hereby has sufficient time in order to change without switching peaks and overswings from one switching state into the other in spite of the great speed, at which the new state is attained.

A fourth switching state can be attained for a setting unit the transformer of which comprises only one single further winding by operating the switches of the setting unit in such a manner that the current circuit of the further winding possesses a high resistance value which also after stepping down on the side of the first winding delivers a high resistance value. In this switching state the entire magnetisation of the transformer core is effected by the magnetic flux of the first winding. This leads to the occurrence of a voltage drop across the first winding dependent on the magnitude of this magnetic flux and thereby on the magnitude of the load current. This choke effect of the first winding in the fourth switching state can be used on the occurrence of a short-circuit at the load to limit the power fed to the load to an undangerous degree.

Furthermore, transformed circuits of the initially named kind are known in which the transformer comprises two further windings the magnetic fluxes and turn ratios of which to the first winding meet the same conditions as they were stated above for the single further winding.

In this case, the setting unit is brought into the first switching state by applying a control voltage to the first further winding only; furthermore, the setting unit is brought into the second switching state by applying a control voltage to the second further winding only.

Preferably, the number of turns, the control voltages and the winding senses of both the further windings are in that case so chosen with respect to the first winding that the amplitudes of both the induceable voltages $\Delta U_1$ and $\Delta U_2$ are about equally great, but both the induceable voltages are imposable with opposite signs on the input voltage $U_E$. In this case again, the above equations (4) and (5) respectively, are true for the first and second switching state, respectively.

The control voltages can be produced and applied to the further windings in different ways. One of these ways is, however, that the first further winding in the first switching state is connected with the aid of the switches directly galvanically with the input voltage $U_E$ of the setting unit, whilst the second further winding in the second switching state is connected directly galvanically with the output voltage $U_A$ of the setting unit so that one obtains an autotransformer arrangement in both switching states. The one of the two further windings finds use exclusively as additive winding and the other exclusively as subtractive winding. Although likewise only one additive induced voltage $+\Delta U_1$ and one subtractive voltage $-\Delta U_2$ stand at disposal thereby, both these voltages are however not constrainedly interlinked each with the other by way of the above equations (6) and (7), since an individual number of turns $w_{w1}$ and $w_{w2}$ can respectively be chosen for each of both the further windings. Applying here for the imposable induced voltages are the equations:

$$+\Delta U_1=(w_1 w_{w1})\cdot U_E \tag{9}$$

and $$-\Delta U_2=\frac{w_1}{w_1+w_{w2}}U_E \tag{10}$$

If one for example chooses $w_{w1}$ and $w_{w2}$ so that $$w_{w1}=w_1+w_{w2}$$

applies, then output voltages $U_A+$ and $U_A-$ lying exactly symmetrically to the input voltage $U_E$ let themselves be attained. Alternatively hereto, the assymmetry between $+\Delta U_1$ and $-\Delta U_2$, which is evident from the equations (9) and (10), can still be enhanced in a desired case.

Beyond that, this embodiment permits one end of each of both the further windings to be connected firmly, and with the aid of a switch either to connect electrically conductively only the respective other end to or to separate it from the input and output voltage, respectively. Less switches are thus needed.

As already mentioned, a transformer circuit of this type is above all of advantage when the voltages $+\Delta U_1$ and $-\Delta U_2$ to be induced amount to only a comparatively small percentage of the input voltage $U_E$. The turns ratios $w_1/w_w$ or $w_1/w_{w1}$ and $w_1/w_{w2}$ are therefore in principle smaller than 1 and preferably lie in a range of 1:3 to 1:200.

This second embodiment can also be provided in different variants, each allowing the attainment of a third switching state, in which the output voltage of the setting unit is virtually equal to the input voltage, in a different way.

A first possibility is to provide switches by means of which at least one and preferably both of the two further windings can be short-circuited.

In order not to overload the transformer, in this case too, special measures are to be provided, which secure that the switch or switches serving for the application of a control voltage is or are closed only for one of the two further windings. For the embodiment with two further windings, of which the one is firmly wired as additive winding and the other firmly as subtractive winding, this means that both the switches must not be operated in overlapping manner. It must also be prevented that a control voltage is applied to one or both of the further windings, whilst the associated short-circuit switch is closed.

In order to make a simultaneous closing of the concerned switches impossible, the switching state of each switch is monitored with the aid of an associated sensor unit and a closing command for a previously open switch is suppressed by a blocking circuit when the output signal of the sensor unit of the other switch indicates that one of these other switches is still closed.

In order that least possible energy losses and smallest possible switching peaks arise during the switching-over from one switching state into the other, it is required in this case respectively to open and close the switches at certain phase angles or in certain phase angle ranges of the magnetic flux which passes through the first winding of the transformer. These phase angles or phase angle ranges are in that case so chosen that this magnetic flux changes little due to the opening or closing operation.

This, however, leads to switching criteria which delay switching-over from one switching state to another so that the new amplitude value of the output voltage cannot be attained stably within one single oscillation period of the alternating load voltage.

Therefore, for a transformer having two further windings, which are connected by a respective one of both their ends with the forward and the rearward end of the first winding, as seen from the voltage source, there is provided for the attainment of a third switching state to connect a series connection consisting of both these further windings in parallel to the first winding; in that case, both these further windings lying in series each with the other can be considered as a single winding displaying a continuous winding sense. Here, too, one obtains a short-circuited transformer with two windings, which are wound in parallel opposition on the core and lie electrically parallel each to the other at the same voltage. The currents in these parallelly opposed windings each try to build up a magnetic field in the core of the transformer, these fields being directed each against the other and substantially cancelling mutually. Again, the above equation (8) applies. The current flowing through both the further windings lying in series each with the other is very small, since these further windings possess a substantially greater impedance than the first winding. Hereby, in this case too, the load current flows practically exclusively through the first winding.

In principle, three switches suffice for a transformer, which possesses two further windings in the above stated manner, in order to be able to bring the setting unit concerned into the named three different switching states.

If no further measures are taken, it must in this case also be observed with care that the input voltage of the setting unit is not applied to the further windings being connected in parallel to the first winding, since an impermissibly high short-circuit current would then flow. This would however mean that certain switching criteria would have to be observed also again here for the opening and closing of the switches, which criteria would delay the attainment of the new amplitude value on the transition from one switching state into another.

In order to avoid this, again preferably the use of one or more current-limiting circuits is provided. In this case, preferably both the switches, by which both the free ends of both the further windings are connected with the terminal connection conductor, are likewise connected directly in galvanically conducting manner each with the other through a further conductor, and a circuit arrangement, which preferably is again constructed as current-limiting circuit, of the above described kind is provided between the further conductor and the terminal connection conductor.

Here, too, during the transition from the first into the second switching state or from the second into the first switching state, initially the previously open switch is closed, whereby the setting unit temporarily passes over into the third switching state; the current-limiting circuit in that case again prevents the flowing of an impermissibly high short-circuit current. The switch, which was closed in the previous switching state, is then opened a short time later, whereby the setting unit passes over into the new switching state.

The explanations given above with respect to the structure and the controlling of the current-limiting circuits apply here in the same manner.

For the switching-over from one switching state to another the following temporal courses result for the present embodiment:

If triacs are used as switches, in the most unfavourable case one must likewise wait for half a period until the appropriate switch can be opened during the transition from the third into the first or second switching state. In that case, it is again without significance whether the setting unit has been disposed in the third switching state for a longer time or runs through it briefly on the switching-over from the first into the second or from the second into the first switching state.

Here, too, on the switching-over into the first or second switching state, the current, which after termination of the switching-over operation flows through the further winding which lies at its control voltage in the new switching state, is displaced in phase relative to the short-circuit current previously flowing through this winding so that the same disturbing voltage peak results as for the above described embodiments.

For switching over more rapidly, here too, it is provided instad of triacs to use electronic switches, each of which, again, comprises two V-MOS-transistors being connected in series each to the other and which can not only be closed, but also again opened at any desired instants.

Again, the waiting times up to the next zero transition are eliminated at the opening operations, and it is possible to use the above described switching criterion which is independent of the zero transition of the short-circuit current, if it is necessary to open a switch for a transition from the third switching state into the first or the second switching state, respectively.

Again, that instant is used as switching instant, in which the current, which after the switching-over operation flows through the further winding lying at its control voltage, possesses its zero transition. Since a different current flows through both the further windings in the third switching state, than when the corresponding further winding lies at its control voltage in the new switching state, here too the time spacing of the zero transition of the last named current from the zero transition of the alternating input voltage at an earlier instant is measured and stored. With the aid of this stored value, again, the above mentioned favourable switching instant can be determined.

By these measures, in this case too, the periods of times, which are necessary for the performance of a switching-over operation can be extraordinarily shortened.

If the setting unit is disposed in the first or in the second switching state and a switching-over into the second or the first switching state becomes necessary, then in the case of the embodiments equipped with V-MOS transistors as switches, the first half of the change occurring in this case in the output voltage lets itself be performed at once at any desired instant and the second half of this change within half a period of the alternating voltage to be switched.

Such a change in or influencing of the output voltage in two very rapidly succeeding steps is extraordinarily advantageous, because the system hereby has sufficient time in order to change without switching peaks and overswings from one switching state into the other in spite of the great speed, at which the new state is attained.

Such a change taking place in two steps is however not possible with a single setting unit when this is already disposed in the third switching state and shall be brought out of this into the first or the second switching state. Although it does in that case change the output voltage by only half of the maximum possible change, yet this half must be managed in a single step.

If more than three different output voltages shall stand at disposal selectably one after the other at the output terminals for a given input voltage of the setting unit, then the transformer can display several further windings which can each possess different numbers of turns. These numbers of turns can lie within the above-mentioned range of 1:3 to 1:200, should however differ one from the other only so far that no too great voltages are induced in the other further windings when the associated voltage is applied to the further winding with the smallest number of turns. Correspondingly many switches can be provided, with the aid of which each of these further windings lets itself be connected to or separated from a control voltage. It is also possible to apply a control voltage each time to only one or simultaneously to two or more of the further windings.

A further possibility to selectably put at disposal more than three different output voltages one after the other at the output of a single setting unit, consists in applying one of several control voltages $U_{S1}, \ldots, U_{S2q}$, which differ at least partially one from the other in their amplitude, alternatively to the at least one further winding with the aid of switches. In that case, q is any integer greater than 1.

For the production of this control voltages $U_{S1}, \ldots, U_{S2q}$, an alternating voltage source preferably finds use, which displays several taps, between which different tapping voltages $U_{X1}, \ldots, U_{Xp}$ are constantly at disposal and tappable. p is likewise an integer greater than 1 and preferably smaller than q. With the aid of switches, these tap voltages can be applied either individually or added in groups as control voltages to the further winding of the transformer.

It is a significant aspect of the invention to create a transformer circuit which in a predeterminable range of variation $\pm\Delta U_{max}$ makes possible a digital change in the voltage applied to a load and thereby also in the power delivered to the load. In that case, the range of variation can in special cases also be only positive or only negative; i.e. either only the additive or only the subtractive imposition of induced voltages $\Delta U$ on the input voltage or the supply voltage may be required. In the following, however, the general case of a range of variation $\pm\Delta U_{max}$ symmetrical to the zero change (input voltage equal to output voltage) will be explained.

Under a digital change in the output voltage in this region $\pm\Delta_{max}$, it is in that case understood that there is a smallest imposable voltage change $+\Delta U_{min}$ or $-\Delta U_{min}$ towards the positive as well as also to the negative side and that positively imposable voltages $+\Delta U_\nu(\nu=1,\ldots,q)$ stand at disposal in the positive part of the variation range and q negatively imposable voltages $-\Delta U_\nu(\nu=1,\ldots,q)$ stand at disposal in the negative part of the variation range, wherein it is true each time:

$$+\Delta U_\nu=\nu\cdot(+\Delta U_{min})$$

and $$-\Delta U_\nu=\nu\cdot(-\Delta U_{min})$$

i.e. any desired imposable voltage $\pm\Delta U_\nu$ is an integral multiple of the associated smallest imposable voltage $\pm\Delta U_{min}$ in the positive as well as also in the negative part of the variation range and that $\nu$ can assume all integers between 1 and q. The greatest possible voltage induceable in each direction is at the same time the limit of the variation range:

$$\pm q\cdot\Delta U_{min}=\pm\Delta U_{max}.$$

One sees that the variation range can be varied through choice of the smallest variation $\pm\Delta U_{min}$ and thereby the step width as well as also through choice of the number q of the steps. An increase in the step width however leads to a reduction in the accuracy, by which the load voltage $U_L$, for example on the use of the transformer circuit according to the invention as regulating device, can be kept constant at a predetermined value. On the other hand, an increase in q means an increase in the technical effort. Thus, an optimisation adapted to the respective case of application must be undertaken in the fixing of the magnitudes q and $\pm\Delta U_{min}$.

Preferably, the amplitudes of $+\Delta U_{min}$ and $-\Delta U_{min}$ are at least approximately equally great so that it is thus at least approximately true also for the remaining induceable voltages:

$$|+\Delta U_\nu|\simeq|-\Delta U_\nu|$$

In corresponding manner, also the control voltages $U_{S\nu}$ to be applied to the further winding are according to the invention structured digitally, i.e. there is a smallest control voltage $U_{Smin}$, which leads to the imposition of the smallest induced voltage $\Delta U_{min}$ and the remaining control voltages are integral multiples of this smallest control voltage:

$$U_{S\nu}=\nu\cdot U_{Smin}$$

wherein $\nu$ again runs through all values from 1 to q. In order to be able to cover the above stated symmetrical variation range $\pm\Delta U_{max}$ by 2q steps, only q control voltages $U_{S\nu}$ must be provided, since each of the voltages tapped off from the alternating voltage source can with the aid of the switches be so applied in two different ways to the further winding that the winding sense of the further winding with respect to the first winding of the transformer in one of both the cases is exactly opposite to the winding sense in the other case. Hereby, the induced voltage $\Delta U_\nu$ is then in one case imposed additively and in the other case subtractively on the input voltage of the setting unit.

Here, too, the possibility again exists of short-circuiting the further winding so that the output voltage of the setting unit is equal to the input voltage or to interrupt the current circuit of the further winding in order to limit the load current through the thereby resulting choke effect of the first winding.

For the production of the q control voltages $U_{S\nu}$, it is according to the invention not required so to provide q+1 taps at the alternating voltage source that a tapping voltage $U_{Xmin}$ corresponding to the smallest control voltage $U_{Smin}$ drops between all respectively immediately adjacent taps.

Rather, the amplitudes of the tapping voltages are so stepped according to a suitable code that all required control voltages $U_{S\nu}$ let themselves be put together through additive combination of several tapping voltages, in so far as they do not correspond directly to one of the voltages which stand at disposal between two adjacent taps, with a minimum number of taps (and thereby a minimum number of switches). In order that the smallest control voltage $U_{Smin}$ stands at disposal, at least one pair of adjacent taps must be provided between which a tapping voltage $U_{Xmin}=U_{Smin}$ drops. Between the remaining pairs of adjacent taps, at least partial tapping voltages can then be provided, which are integral multiples different from 1 and to be fixed according to the above mentioned code, of the smallest tapping voltage $U_{Xmin}$. The most favourable code is here the pure binary code, in which each tapping voltage occurs only once and the tapping voltages $1.U_{Xmin}$, $2.U_{Xmin}$, $4.U_{Xmin}$, $8.U_{Xmin}$ and so forth drop in sequence between successive tap pairs.

The use of this code however presupposes that tap pairs, which are not needed for the additive composition of a just required control voltage $U_{S\nu}$, can readily be short-circuited.

The above mentioned condition for the use of a pure binary code is not given in an alternating voltage source, which is preferred according to the invention and consists of a auxiliary transformer arrangement with a winding which is applied to an alternating voltage and subdivided into a plurality of winding portions, between which the taps for the tapping of the tapping voltages $U_{X1},\ldots U_{Xp}$ are led out. Therefore, a code is preferably used here, which permits every required control voltage to be tapped off from a group of immediately successive tapping pairs in so far as it can not be tapped off directly from a single tapping pair. In general, this means that at least the smallest tapping voltage $U_{Xmin}$, in many cases however also some of the integral multiples thereof, must be tappable several times. Thus, for example, for the production of eight control voltages $$1.U_{Smin},\ 2.U_{Smin},\ldots,\ 8.U_{Smin}$$

at the winding of the auxiliary transformer arrangement, four winding portions can be provided, the number of turns of which are so chosen that the tapping voltages $$1.U_{Xmin},\ 2.U_{Xmin},\ 4.U_{Xmin},\ 1.U_{Xmin}$$

drop in sequence at the taps, wherein $U_{Xmin}=U_{Smin}$. One sees that the control voltages $1.U_{Smin}$, $2.U_{Smin}$ and $4.U_{Smin}$ can be tapped off directly at the first or second or third winding portion (counted from the left in the above series), while the control voltage $3.U_{Smin}$ can be tapped off through a combination of the first and second winding portion, the control voltage $5.U_{Smin}$ through a combination of the third and fourth winding portion, the control voltage of $6.U_{Smin}$ through a combination of the second and third winding portion, the control voltage $7.U_{Smin}$ through a combination of the first, second and third winding portion and the control voltage $8.U_{Smin}$ through the combination of all four winding portions. The code just given as example is however not the only possible for this number of required control voltages and four winding portions put at disposal. For example, all eight control voltages can also be tapped off when the integral multiples of the smallest tapping voltage correspond to the code 1,3,2,2.

Preferably, the number of turns of the winding portions are so chosen that the tapping voltage $1.U_{Xmin}$ is tappable off directly at the one of both the ends of the winding portion series and the tapping voltage $1.U_{Xmin}$ at the portion which lies at the opposite end, as is also the case in the first of both the above examples.

It is essential that the code is always so chosen that all required control voltages $U_{S\nu}$ stand at disposal with the minimum number of winding portions or taps. Beyond that, the maximum alternating voltage, which is tappable off through the combination of all winding portions, shall if possible be equal or at least not substantially greater than the maximum required control voltage $U_{Smax}$.

Preferably, the auxiliary transformer arrangement consists only of a single winding, which is subdivided into the different portions and at the outermost ends of which is applied a corresponding alternating voltage. The input voltage or the output voltage of the setting unit itself can for example serve for this.

In order to be able to use a transformer circuit, which consists of a single setting unit, at the further winding of which different control voltages can be applied in the just described manner with the aid of switches, as voltage stabiliser and/or voltage regulator, it is furthermore provided that the voltage $U_L$ applied to the load is measured with the aid of a measuring sensor arrangement, that a comparator compares the output signal of the measuring sensor arrangement with a reference value $U_{ref}$, which represents the target value $S_L$ of the load voltage, and that a switch control is provided, which so controls the switches with the aid of the difference signal, which is delivered by the comparator arrangement, that the voltage changes $\Delta U_\nu$ induced in the first winding of the transformer counteract possibly arising fluctuations in the load voltage $U_L$ and compensate for these fluctuations.

If one wants to be able to put more than three different load voltages at disposal one after the other for a given supply voltage $U_V$, then, according to a further embodiment, it is advantageous to provide a transformer circuit, in which two or more stages, of which each can consist of one or more setting units, are so connected in series one with the other that the supply voltage $U_V$ is present as input voltage $U_E$ at the first stage, the output voltage $U_A$ of this first stage is applied as input voltage $U_E$ at the second stage and so forth and that the output voltage of the last stage is conducted to the load as load voltage $U_L$. In that case, seen from the voltage source, the first windings of the transformers of all stages lie in series one with the other and with the load.

The stages connected one in series with the other can each consist of a single setting unit, which is equipped with one or more, particularly two further windings, and which, according to the previous described embodiments, can be brought at least into the three different switching states defined by the above equations (4), (5) and (8).

Alternatively hereto, the stages of such a transformer circuit can however also each consist of two setting units which are connected each in series with the other and combined into a setting unit pair.

To be understood by this is the following: Two setting units are concerned here, which likewise display two further windings, of which the one finds use as additive and the other as subtractive winding.

The two transformers are so dimensioned that each of both the setting units is capable of effecting about half of the total voltage change, which shall be applied by the setting unit pair, in additive as well as also in subtractive manner. If, for example, the setting unit pair is to be able to change its input voltage $U_{EP}$ by $\pm\Delta U_P$, then each of both the setting units on its own can change the input voltage fed to it by about $\pm\Delta U_P/2$. If each of both the setting units is disposed in its first switching state, then this is designated as first switching state combination of the setting unit pair and it is true for the output voltage of the setting unit pair that $$U_{AP1}=U_{EP}+\Delta U_P, \tag{11}$$

when $U_{EP}$ is the input voltage of the setting unit pair.

If each of both the setting units is disposed in its second switching state, then this is designated as second switching state combination of the setting unit pair and it is true that $$U_{AP2}=U_{EP}-\Delta U_P. \tag{12}$$

Furthermore, the turns ratios of both the transformers are so matched each to the other that the effects of both the setting units each compensate the other when the setting unit pair is disposed in a third switching state combination; in this third switching state combination, for example, the first setting unit, i.e. the one lying nearer to the supply voltage source, is disposed in the first and the second setting unit in the second switching state. It is then true for the output voltage of the setting unit pair that $$U_{AP3}=U_E+\tfrac{1}{2}\Delta U_P-\tfrac{1}{2}\Delta U_P=U_{EP}. \tag{13}$$

It is in that case of great advantage that the losses, which occur in the setting units, are extremely small in all three switching state combinations. Particularly also the unchanged transmission of the input voltage to the output of the setting unit pair in the third switching state combination takes place practically free of loss.

By comparison with a setting unit, which on its own can assume the three switching states corresponding to the equations (4), (5) and (8), such a setting unit pair possesses the advantage that only half the voltage change or power change envisaged for the stage concerned need be exerted by each individual setting unit. Although two transformers are needed, these can yet also be dimensioned to be appreciably smaller and lighter corresponding to half the load. This is of advantage particularly in the manufacture, the transport as well as for the replacement part inventory of transformer circuits.

In general, the fourth switching state combination, in which the first setting unit is disposed in the second switching state and the second setting unit in the first switching state, remains unused for a setting unit pair. The just made statements let themselves be summarised in the following table 1:

TABLE 1

| Switching state combination | Setting unit 1 | Setting unit 2 | Output voltage |
|---|---|---|---|
| 1 | + | + | $U_{A1} = U_E + \Delta U_P$ |
| 2 | − | − | $U_{A2} = U_E - \Delta U_P$ |
| 3 | + | − | $U_{A3} = U_E$ |

Accordingly, it is in principle not necessary here that each of both the setting units of the setting unit pair can be brought on its own into the third switching state.

Preferably, each of both the setting units is however also in the case of a setting unit pair so constructed that the one further winding or the two further windings can be connected in parallel with the first winding, so that each of the two setting units can on its own be brough into the third switching state; if one does in that case provide the above mentioned current-limiting circuit or circuits in each setting unit, then an extraordinarily rapid switching-over, taking place in several partial steps, from each switching state combination of the setting unit pair into each other switching state combination lets itself be performed with the aid of V-MOS transistor switches.

When the setting unit pair is to be brought, for example, out of the second switching state combination ($U_{AP2}=U_{EP}-\Delta U_P$) into the third switching state combination ($U_{AP3}=U_{EP}$), then this can occur without delay in such a setting unit pair thereby, that in both setting units the switch is closed, through the closing of which the setting unit is on its own brought into its third switching state, as was described above. Thereby, a further switching state combination results, which in respect of the output voltage $U_{AP}$ of the setting unit pair is equivalent to the third switching state combination described above. It is true also here that $U_{AP3}'=U_{EP}$. This change in the output voltage by $\Delta U_P$ can take place at any desired instants and the output voltage goes practically without delay from the old voltage value $U_{AP2}$ over to the new voltage value $U_{AP3}'$.

The corresponding is valid for a transition of the setting unit pair out of the first switching state combination ($U_{AP1}=U_{EP}+\Delta U_P$) into the further switching state combination.

It is however expedient to switch the setting unit pair out of this further switching state combination into the above described third switching state combination when the output voltage $U_{AP}$ shall remain equal to the input voltage $U_{EP}$ for a longer time. This takes place at the respectively favourable instants thereby, that the first setting unit is brought into its first switching state and the second setting unit into its second switching state through the opening of the appropriate switches. The output voltage of the setting unit pair in that case passes from $U_{AP3}'=U_{EP}$ over to $U_{AP3}=U_{EP}$, thus practically does not alter.

The third switching state combination has the advantage compared with the further switching state combination that a transition out of it into the first or the second switching state combination can if required take place in two equally large change steps, of which the first is performable without any delay thereby, that the second or the first setting unit is brought into its third switching state through closing of the switch concerned. Thereby, the output voltage of the setting unit pair goes instantaneously from $U_{AP3}=U_E$ over to $U_E+\Delta U_P/2$ or $U_P-\Delta U_P/2$. At the next favourable instant, which occurs at the latest within the next half period of the alternating voltage, the second or the first setting unit is then brought out of the third into the first or the second switching state, whereby the setting unit pair passes over into the first or second switching state combination, respectively, in which $U_{AP1}=U_E+\Delta U_P/2+\Delta U_P/2$ and $U_{AP2}=U_E-\Delta U_P/2-\Delta U_P/2$ applying respectively.

The transition from the first into the second or from the second into the first switching state combination likewise takes place in two steps, of which the first can be performed at once and the second at the latest within the next half period of the alternating voltage. In this case, the first step consists in that both setting units are brought simultaneously into their third switching state through closing of the appropriate switches; in the second step, both the setting units are then transferred respectively into their second and their first switching state through opening of the appropriate switches.

If a transformer circuit consisting of one or more such setting unit pairs (which can then effect different voltage changes), is used as voltage regulator or voltage stabiliser, then also the extremely high demands in respect of the switching speed and switching accuracy, as they are for example set in the current supply of data processing plants, let themselves be fulfilled by it.

In order to be able to cover a greater range of output voltage values in small voltage steps, it is advantageous to connect several stages, which can consist either of single setting units, each of which can individually be brought into the third switching state, or of the above described setting unit pairs (wherein also both kinds can be mixed in one arrangement), in series one behind the other and to choose the voltage differences $\pm\Delta U_1, \ldots, \pm\Delta U_n$, which n such stages can produce, to be different one from the other. It is particularly advantageous when the percentage values, which result when one divides each of these voltage differences by the supply voltage divided by 100, stand in the ratio of integer powers of three one to the other.

Thus, if it is true for the smallest voltage difference $\pm\Delta U_{min}$ producible by one of the stages:

$$\frac{\pm\Delta U_{min}}{U_V} \cdot 100 = A\ \%$$

then the voltage differences of the other stages are so chosen that they are about equal to ±3A%, ±9A% and so forth of the supply voltage $U_V$.

If, for example, three stages are connected one behind the other in a transformer circuit and the three above named switching states or switching state combinations are used for each stage, then twenty-seven combinations of switching states are possible for the entire transformer circuit, of which combinations one permits the supply voltage delivered by the voltage source to get to the load with almost unchanged amplitude, whilst thirteen combinations increase the amplitude of the supply voltage by about integral multiples of A% and thirteen combinations lower this amplitude by about integral multiples of A%. This is illustrated more exactly in table 2.

In this table, the running number n of the respective combination of switching states is reproduced in the lefthand column, wherein it is indicated by the index "+" or "−" whether a combination is concerned, which leads to an increase "+" in the amplitude of the supply voltage or a combination which lowers the supply voltage ("−").

TABLE 2

| Combination n | Switching state of the stages with a change by 9A% | 3A% | A% | Imposed amplitude change in % |
|---|---|---|---|---|
| 0 | 0 | 0 | 0 | 0 |
| $1^+$ | 0 | 0 | + | +1A |
| $2^+$ | 0 | + | − | +2A |
| $3^+$ | 0 | + | 0 | +3A |
| $4^+$ | 0 | + | + | +4A |
| $5^+$ | + | − | − | +5A |
| $6^+$ | + | − | 0 | +6A |
| $7^+$ | + | − | + | +7A |
| $8^+$ | + | 0 | − | +8A |
| $9^+$ | + | 0 | 0 | +9A |
| $10^+$ | + | 0 | + | +10A |
| $11^+$ | + | + | − | +11A |
| $12^+$ | + | + | 0 | +12A |
| $13^+$ | + | + | + | +13A |
| $1^-$ | 0 | 0 | − | −1A |
| $2^-$ | 0 | − | + | −2A |
| $3^-$ | 0 | − | 0 | −3A |
| $4^-$ | 0 | − | − | −4A |
| $5^-$ | − | + | + | −5A |
| $6^-$ | − | + | 0 | −6A |
| $7^-$ | − | + | − | −7A |
| $8^-$ | − | 0 | + | −8A |
| $9^-$ | − | 0 | 0 | −9A |
| $10^-$ | − | 0 | − | −10A |
| $11^-$ | − | − | + | −11A |
| $12^-$ | − | − | 0 | −12A |
| $13^-$ | − | − | − | −13A |

"+" in the middle column means that the one setting unit or both the setting units of a pair is or are disposed in the first switching state so that the amplitude of the supply voltage is increased by 9A%, 3A% or A%, whilst a "−" means a corresponding reduction and "O" symbolises the third switching state of a single setting unit or the switching state combination 3 (see Table 1) of the setting unit pair concerned, in which the amplitude of the alternating input voltage is transmitted unchanged. The total changes in the amplitude, which are attainable through the respective combination of the switching states of all stages, are reproduced in the righthand column. In that case, only rounded values are stated, which do not take into consideration that the input voltage of the stages arranged nearer to the load can change in dependence on the switching state of the preceding stages.

One sees that the amplitude change takes place in discrete steps with the aid of such a transformer circuit according to the invention, wherein the step width from one switching state combination to the next is always about equal to A% of the respective supply voltage.

When one stage is built up of two setting units, which form a pair, then alternatively to the just explained arrangement, also only two switching state combinations of each setting unit pair can find use, for example the switching state combination O, in which the output voltage is equal to the input voltage, and the combination "−", in which the output voltage is lower than the input voltage by n.A%, wherein n assumes a different whole number value for each setting unit pair. It is possible so to construct the setting unit pairs for this case of application that they can assume only both these switching state combinations. This can occur in the manner that, for example, the front setting unit of each pair displays a firmly wired, not switchable further winding which permanently, for example, induces a negatively imposed voltage −(n/2).A%, whilst the second setting unit possesses an additive and a subtractive further winding, which can be so connected alternatively that they induce either a voltage of +(n/2).A% or of −(n/2).A%, which in combination with the induced voltage −(n/2).A% of the front setting unit results in a voltage change of either 0 or −n.A%. Correspondingly, setting unit pairs can also be provided, which can assume only both the switching state combinations O and +n.A%.

In all these cases, the change in the output voltage of the entire transformer circuit relative to the input voltage takes place not according to the ternary code reproduced in table 2, but according to a binary code. Although more setting unit pairs are here needed for the covering of the same voltage change range than for the ternary code, there are however cases of application, in which the input voltage shall in any case be changed in only one direction starting from a total change 0 and/or the voltage change range is not great. Then, the advantage of a purely binary driving can in some circumstances outweigh the increased need of setting units.

Independently of how many stages are connected one behind the other and whether a binary or a ternary or another code finds use, it is a conspicuous feature of a transformer circuit according to the invention and built up in such a manner that it permits a stepwise or digital influencing even of very great powers. By contrast to systems operating in analog manner, it possesses an extraordinarily high regulating or control speed. The respectively attained accuracy in that case depends substantially only on the number of the setting units or stages employed.

The typical and preferred case of application of a transformer circuit, according to the invention and consisting of two, three or more stages, however does not consist in that nine, twenty-seven or more output voltages shall be producible selectably one after the other starting from a fixed supply voltage originating from a voltage source.

Rather, the use of such a transformer circuit as voltage stabiliser and/or voltage regulator is provided in a particularly preferred case of application. This means that either the nominal value of the supply voltage $U_V$ delivered by the voltage source or another voltage value can be chosen as target value $S_L$ for the voltage fed to the load. However, such a different target value must lie within the change range of the transformer circuit according to the invention. If it lies very close to the limit of this change range, then a regulation of the load voltage $U_L$ is possible only for deviations from the target value $S_L$ in one direction. This is however completely adequate in cases, in which deviations do not occur in the other direction.

In the following, the application as symmetrical voltage regulator is explained more exactly, with the aid of which it is prevented that the amplitude of a load voltage fed to a load deviates from a predetermined target value $S_L$ by more than $\pm\delta\%$, which is equal to the nominal value of the supply voltage $U_V$, which can fluctuate in a substantially greater range, for example by maximally $\pm\Delta\%$ of the nominal value.

For this purpose, a circuit arrangement comprises—apart from a transformer circuit with appropriately many stages—a measuring sensor arrangement, which measures the amplitude of the supply voltage and/or the amplitude of the load voltage, a comparator arrangement, which compares the measuring sensor signal or signals with one or more reference values and in the case of deviations produces corresponding difference signals, as well as a switch control, which compares these difference signals for example with a firmly programmed-in table of difference signal values. From this comparison, the switch control determines that combination n+ or n− of switching states (see Table 2), which is required for a compensation of the arisen deviation of the supply voltage from the nominal value, so that the load voltage remains within the predetermined range $S_L \pm \delta\%$.

Let it now be assumed that the amplitude of the supply voltage initially corresponds to the nominal value and thereby also to the target value $S_L$, then however in the course of time deviates, for example upwardly, from this nominal value to an increasing degree: In this case, the switch control must pass over from the initially present switching state combination n=0 (see Table 2), in which the load voltage $U_L$ is equal to the supply voltage $U_V$, in good time to the switching state combination n=1−, on further rising to the combination n=2− and so forth. Thereby, a corresponding whole number multiple of A% is subtracted from the supply voltage and the load voltage is thereby held in the desired range $S_L \pm \delta\%$.

In the case of steadily increasing positive deviation, the transition from the n−th combination to the (n+1)−th combination each time takes place at a certain switching threshold $SW_{n-/(n+1)-}$, i.e. a fixed amplitude value of the supply voltage. When the positive deviation again steadily decreases, then the transition from the (n+1)−th combination to the n−th combination of switching states takes place in reverse direction at about the same switching threshold. It is advantageous to separate both the last named switching thresholds by a small voltage difference each from the other. Through the thus obtained "hysteresis", too frequent a switching play is prevented in those cases, in which the supply voltage $U_V$ for a longer time possesses a value, which is equal to a switching threshold, and fluctuates slightly around this value.

The corresponding applies also to negative deviations of the amplitude of the supply voltage from the nominal value, except that the switching thresholds are here designated by $SW_{n+/(n+1)+}$, because one must in this case with increasing downward deviation go over from the additive imposition of n times the minimum amplitude change A% to the additive imposition of (n+1) times of A% in order to attain the desired constancy of the amplitude of the load voltage.

On each transition from one combination of switching states to a neighbouring combination, the amplitude of the load voltage changes in steplike manner by about A%. Preferably, the switching thresholds are so fixed that when the amplitude of the supply voltage passes through the value of the concerned switching threshold without steplike change, the amplitude values $U_{Lvor}$ and $U_{Lnach}$ lie symmetrically to the target value. In that case, ULvor is the amplitude of the load voltage before the switching-over operation and $U_{Lnach}$ the amplitude of the load voltage after the switching-over operation. It shall thus be true to the best possible approximation:

$$|S_L - U_{Lvor}| = |S_L - U_{Lnach}|; \quad (14)$$

furthermore, $|U_{Lvor} - U_{Lnach}| = (A \cdot S/100)$ is true. Although the percentage value A is constant, it is however not referred to the target value $S_L$, but to the amplitude of the input voltage of the respective stage. Thus, the magnitude of $U_{Lvor}$ and $U_{Lnach}$ is dependent on from which combination of switching states a transition takes place to a neighbouring combination.

The above equation (14) can be adhered to in each case by suitable choice of the switching thresholds SW. It is also possible according to the invention to secure by an appropriate choice of A that $U_{Lvor}$ and $U_{Lnach}$ lie within the amplitude range predetermined by the desired accuracy of regulation $S_L \pm \delta\%$, wherein the percentage value is referred to the target value $S_L = 100\%$.

In the fixing of the value of A, it is to be observed that on the one hand A shall be as great as possible in order that as few setting units as possible are required to cover a given fluctuation range Δ, that on the other hand A may however not be chosen to be too great, because the desired accuracy of regulation δ may otherwise not be adhered to. According to the invention, A is preferably so chosen that it lies between 1.6 times δ and 1.8 times δ.

It is here pointed out once again that the switching thresholds can be used independently of whether the circuit arrangement operates as voltage stabiliser or as voltage regulator, thus whether the load voltage $U_L$ is kept to a target value $S_L$, which is equal to the nominal value of the supply voltage delivered by the voltage source, or to a target value which differs from this nominal value.

The use of these switching thresholds is also independent of whether the supply voltage or the load voltage is measured by the measuring sensor arrangement. In the first case, the difference of the above switching thresholds from the target value $S_L$ can be contained directly in the table used by the switch control, by which the difference signal delivered from the comparator is compared. In the second case, the switch control must determine from the approach of the amplitude of the load voltage to one of the values $U_{Lvor}$ and $U_{Lnach}$ and/or the knowledge of the instantaneously valid combination of switching states which switching threshold is just being approached by the supply voltage and which switching-over must therefore be undertaken.

A further possibility consists in that the measuring sensor arrangement measures the amplitude of the alternating voltages in front of and behind the transformer circuit. Thus, the changes in the supply voltage $U_V$ as well as also in the load voltage $U_L$ are then detected and so evaluated that the switches of the setting units are so controlled that as good as possible a constancy of the amplitude of the voltage fed to the load results.

Advantageously, a transformer circuit can be used in multi-phase systems with or without neutral conductor. Provided in the first case for each phase is at least one setting unit, the first winding of which each time so lies in the phase conductor concerned that it is flowed through by the load current flowing in this phase conductor, whilst the terminal connection conductor of each setting unit is connected with the neutral conductor of the multi-phase system.

If the multi-phase system displays no neutral conductor leading from the voltage source to the consuming device, then the first windings of the setting unit, which are provided for a certain phase, are again connected into the phase conductor and all terminal connection conductors are connected one with the other, whereby an artificial neutral conductor is formed, which can lie at any desired potential.

Finally, in a multi-phase system without neutral conductor, the setting units provided for the different phases can be arranged in an interlinked circuit.

BRIEF DESCRIPTION OF THE DRAWING

The invention is described in the following with the aid of examples of embodiment and with reference to the drawing; in this, there show.

DESCRIPTION OF PREFERRED EMBODIMENTS OF THE INVENTION

Figure 1:
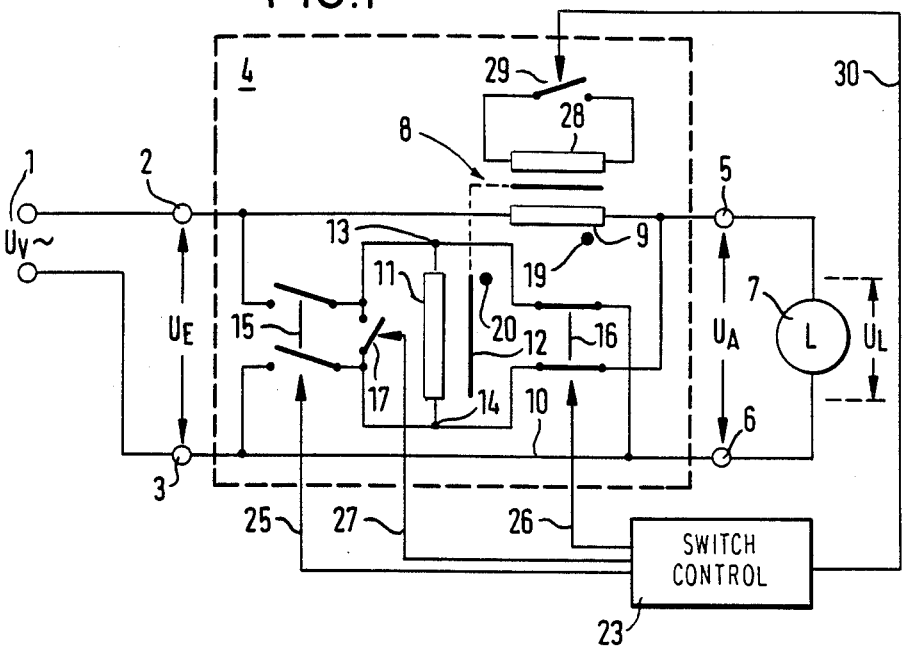
FIG. 1 a transformer circuit, in which between a voltage source and a load a setting unit is arranged which, according to a first embodiment, has a transformer with one single further winding which can be short-circuited, FIG. 2 a transformer circuit, in which between a voltage source and a load, a setting unit is arranged which, according to a second embodiment, has a transformer with two further windings each of which can be short-circuited, FIG. 3 a portion of FIG. 2, which reproduces the details of a sensor unit, FIG. 4 two setting units connected in series each with the other, forming a setting unit pair and each, according to a third embodiment, having a transformer with two further windings which cannot be short-circuited, FIG. 5 a transformer circuit built up as single-phase voltage stabiliser with three stages connected in series, FIG. 6 a further embodiment of a voltage stabiliser for a three-phase system, FIG. 7 an embodiment, in which a single setting unit can be brought into a plurality of switching states and finds use as voltage regulator, FIG. 8 a further embodiment of a setting unit for a transformer circuit according to the invention, in which the transformer displays only a single further winding, which can be connected in parallel with the first winding, FIG. 9 an embodiment of a setting unit for a transformer circuit according to the invention, in which the transformer comprises two further windings, a series connection of which can be connected in parallel with the first winding, FIG. 10 the build-up of a current-limiting circuit, as it finds use in the setting units reproduced in the FIGS. 8 and 9, and FIG. 11 a diagram for explanation of the choice of the most favourable switching instants on the transition from one switching state into another.

FIG. 1 shows an alternating voltage source 1, which delivers a supply voltage $U_V$, which is conducted to the input terminals 2 and 3 of a setting unit 4 as input voltage $U_E$. An output voltage $U_A$, which is conducted as load voltage $U_L$ to a load 7, appears at the output terminals 5 and 6 of the setting unit 4.

The amplitude of the output voltage $U_A$ is variable relative to the amplitude of the input voltage $U_E$ with the aid of the setting unit according to the invention. For this purpose, the setting unit 4 comprises a transformer 8, the first winding 9 of which is connected between the input terminal 2 and the output terminal 5, whilst the input terminal 3 is connected with the output terminal 6 directly in galvanically conducting manner by means of the terminal connection conductor 10. In this manner, seen from the voltage source 1, the first winding 9 is connected in series with the load 7.

The transformer 8 possesses a further winding 11, which is magnetically coupled by way of the iron core 12 of the transformer 8 with the first winding 9 thereof. Two switch pairs 15 and 16 as well as a short-circuit switch 17 are connected with both the ends 13 and 14 of the further winding 11.

The setting unit 4 can be brought into four different switching states with the aid of both the switch pairs 15 and 16 and the short-circuit switch 17. In the first switching state, in which the switch pair 15 is closed and the switches 16 and 17 are opened, the input voltage $U_E$ is applied to the further winding 11. The winding sense, defined by the points 19 and 20, of the windings 9 and 11 is in that case so chosen that the voltage $\Delta U_1$, which in this first switching state is induced by the further winding 11 in the first winding 9, is added to the input voltage $U_E$. One thus obtains the voltage $$U_{A1}=U_E+\Delta U_1$$

between the output terminals 5 and 6 of the setting unit. As already mentioned, the value, i.e. the absolute amplitude amount of the induced voltage $\Delta U_1$ is in that case fixed by the turns ratio $w_1/w_w$ of the first winding 9 to the further winding 11 according to the equation $\Delta U_1=w_1U_E/w_w$.

In the second switching state, which is illustrated in FIG. 1, the switches 15 and 17 are opened and the switch pair 16 is closed, whereby the output voltage $U_A$ of the setting unit 4 is applied to the further winding 11. At the same time, the winding sense of the further winding 11 is reversed relative to the first switching state. Thereby, the voltage $\Delta U_2$, which in this switching state is induced in the first winding 9 of the transformer 8, is subtracted from the input voltage $U_E$ so that one obtains $$U_{A2}=U_E-\Delta U_2$$

at the output 5 and 6. In this case, $\Delta U_2=w_1U_E/(w_w+w_1)$ is true for the induced voltage. Since the turns ratio of the first winding 9 to the further winding 11 is according to the invention typically smaller than 1:7, the voltage $\Delta U_2$ induced in the second switching state is thus always somewhat smaller than the voltage $\Delta U_1$ induced in the first switching state. However, the increase in the output voltage $U_A$ relative to the input voltage $U_E$, which is attainable in the first switching state by the circuit arrangement according to FIG. 1, can in practice be made equal with very good accuracy to the voltage reduction attainable in the second switching state, since the first winding 9 represents a complex impedance for the load current flowing from the voltage source 1 to the load 7. Since the first winding 9 generally comprises only very few windings, this impedance is indeed small, yet it leads to a certain voltage drop which is independent of the switching state of the setting unit 4. The value of $U_A$ thus in both switching states lies somewhat below the values which result from the above simplified equations. The output voltages attainable in both the switching states therefore lie with good accuracy symmetrically to the input voltage:

$$U_{A1,2}=U_e\pm\Delta U.$$

In a third switching state of the setting unit 4, both the switch pairs 15 and 16 are opened and the short-circuit switch 17 is closed. The current circuit consisting of the thereby short-circuited further winding 11 possesses a very small resistance which, by reason of the fact that the turns ratio $w_1/w_w$ is substantially smaller than 1, appears correspondingly transformed down on the side of the first winding 9. Thereby, the first winding 9 in this switching state represents an extremely small resistance, across which practically no voltage drops, for the load current so that it is here true to very good approximation:

$$\Delta U_3=0$$

or $$U_{A3}=U_E.$$

Because of the extremely small voltage drop across the first winding 9, only a small voltage is also induced in the further winding 11 so that in spite of the short-circuit only a relatively small short-circuit current flows through the further winding 11. The losses occurring in this case can be kept far smaller than 1% of the power delivered to the load 7.

Since the losses occurring in the setting unit 4 in both the first switching states also lie far below 1% of the load power, such a transformer circuit forms an extraordinarily advantageous possibility of digitally putting at disposal three different output voltages $U_A$ starting from a given input voltage $U_E$.

In a fourth switching state, all switches 15, 16 and 17 are opened. The current circuit of the further winding 11 then possesses a nearly infinitely high resistance value which also after transforming-down supplies a high resistance value on the side of the first winding 9 so that a voltage drop dependent on the magnitude of the load current occurs across the first winding. This choke effect of the first winding 9 in the fourth switching state can be used on the occurrence of a short-circuit at the load to limit the power fed to the load to a non-dangerous degree for at least until further switching-off measures can be taken.

Both the switch pairs 15 and 16 as well as the short-circuit switch 17 are actuated through a switch control 23, which drives the switches 15, 16 and 17, which can for example be formed by triacs, in the required manner by way of the lines 25, 26 and 27. In that case, care is taken that the switches 15, 16 and 17 are never closed at the same time and the time spans, in which a transition is made from one switching state into another, is on the other hand kept as short as possible. On a transition from the first or second switching state into the third or conversely, the switch pairs 15 and 16, respectively, must be opened shortly before the instant and closed shortly after the instant, in which the short-circuit switch 17 is respectively closed and opened. On a transition from the first into the second or from the second into the first switching state, an almost simultaneous closing and opening of the switches is not favourable, as is explained more exactly further below. Rather, a short time spacing is maintained between the opening of the previously closed switch pair and the closing of the previously opened switch pair.

In order to avoid that it comes to a trough in the output voltage $U_A$ in these short switch-over time spacings by reason of the above described choke effect of the first winding 9, the transformer 8 in the example of embodiment illustrated in FIG. 1 possesses an own short-circuit winding 28, which can be short-circuited with the aid of a switch 29, which lies parallel to it. This switch 29 is driven by the switch control 23 by way of a line 30 and closed only for those time spaces, during which both the switch pairs 15 and 16 are temporarily opened at the same time during the switching-over from one switching state into the other.

Figure 2:
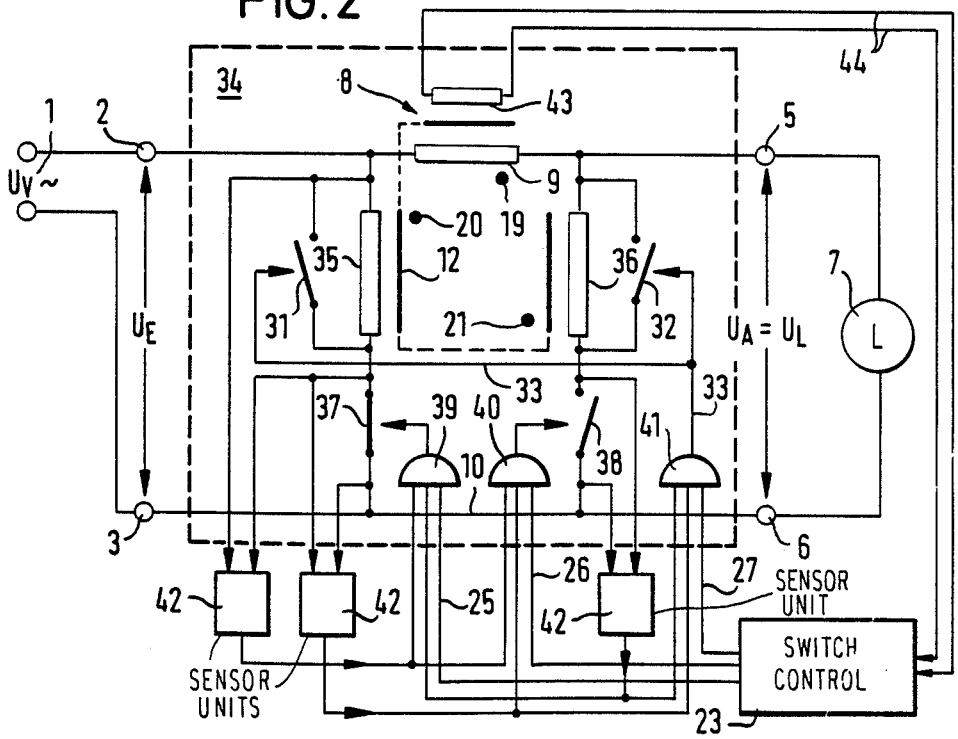

Illustrated in FIG. 2 is a transformer circuit with a setting unit 34, the build-up of which differs from that of the setting unit 4. The function of the setting unit 34 is however in principle the same as that of the setting unit 4.

The setting unit 34 again comprises a transformer 8, the first winding 9 of which is connected between the input terminal 2 and the output terminal 5, while the other input terminal 3 is connected directly by way of the terminal connection conductor 10 in galvanically conducting manner with the other output terminal 6.

Other than for the setting unit 4 of FIG. 1, the transformer 8 in the present case possesses two further windings 35 and 36, of which the one as additive further winding 35 is connected by its one end firmly in galvanically conducting manner with that end of the first winding 9, which is connected directly in galvanically conducting manner with the input terminal 2, while the other end of the additive winding 35 can with the aid of a switch 37 be connected with or separated from the terminal connection conductor 10. The other of both the further windings is connected as subtractive further winding 36 by its one end firmly and directly in galvanically conducting manner with that end of the first winding 9, which is directly connected in galvanically conducting manner with the output terminal 5 of the setting unit 34, while the other end of the subtractive further winding 36 can be connected with or separated from the terminal connection conductor 10 with the aid of a switch 38. The winding sense of the three windings 9, 35 and 36, which are magnetically coupled one with the other by way of the core 12, is characterised by the points 19, 20 and 21. It is so chosen that the voltage $\Delta U_1$, which is induced in the first winding 9 by the additive winding 35 when the switch 37 is closed, is added to the input voltage $U_E$ and that the voltage $\Delta U_2$, which is induced in the first winding 9 by the subtractive winding 36 when the switch 38 is closed, is subtracted from the input voltage $U_E$.

Arranged in parallel with each of both the further windings 35 and 36 is a respective short-circuit switch 31 and 32, which in the closed state short-circuits the associated further winding 35 or 36. Both the short-circuit switches 31 and 32 are so driven in common by way of a line 33 that they are always opened or closed at the same time. The switches 31, 32, 37 and 38 are so driven that either only the switch 37 or only the switch 38 or only the switches 31 and 32 are closed. Thereby, the setting unit 34 can be brought into the same three switching states as was described above for the setting unit 4. Just so, the setting unit 34 can through opening of all switches 31, 32, 37 and 38 be brought into a corresponding fourth switching state which does not serve as "normal" operating state, but can be used for limitation of the load short-circuit current in the case of a load short-circuit.

In principle, it would suffice to provide only one short-circuit switch 31 or 32 and close it for the production of the third switching state. If one however short-circuits both further windings 35 and 36, then only half the short-circuit current flows in each of the windings 35 and 36, which makes a smaller dimensioning possible. Whether this outweighs the disadvantage of a second short-circuit switch, is a question of optimisation to be decided in the concrete individual case.

In all cases, one switch less is needed in the example of embodiment according to FIG. 2 than in the example of embodiment in FIG. 1, whereby the disadvantage of a second further winding is balanced to a large extent.

Beyond that, the embodiment illustrated in FIG. 2 affords the possibility of selecting $\Delta U_1$ within certain limits of $\Delta U_2$ so that both the output voltages $U_{A1} = U_E + \Delta U_1$ and $U_{A2} = U_E - \Delta U_2$ thus need not necessarily lie any longer symmetrically to the input voltage $U_E$ here.

In the present example of embodiment, too, a switch control 23 is provided, which delivers the driving signals for the switches 37, 38, 31 and 32 by way of the lines 25, 26 and 27. However, the lines 25, 26 and 27 are connected not directly with the switches 37, 38, 31 and 32, but are each applied to an input of an AND-gate 39, 40 and 41, the other inputs of which are driven by sensor units 42. Each of the sensor units 42 possesses two input terminals, with the aid of which it interrogates the voltage dropping across the associated switch 37, 38 and 31, respectively. The sense of these sensor units 42 and the AND-gates 39, 40 and 41 is to make certain that each of both the switches 37 and 38 or both the switches 31 and 32 can be closed through a corresponding signal of the switch control 23 only when the respective other switches have been opened previously.

If for example the switch 37 of the setting unit 34 is closed as illustrated in FIG. 2 then no voltage drops across this switch 37. Therefore, the associated sensor unit 42 at its output produces a logic O-signal which blocks the AND-gates 40 and 41 and prevents that a closing signal can get from the switch control 23 to the switches 38, 31 and 32. These switches can thus be closed only after the switch 37 has been opened, which the sensor 42 indicates in that it feeds a logic 1 to the AND-gates 40 and 41. The same applies of course conversely also to the interrogation of the closing state of the switches 38, 31 and 32 by the associated sensor units 42 and a corresponding blocking or freeing of the AND-gate 39.

If triacs are used as switches 37, 38, 31 and 32, then these can of course not be driven directly through the AND-gates 39, 40 and 41, but one of the usual triac driving circuits, which have been omitted for the sake of clarity in FIG. 2, is provided between the output of these AND-gates and the gate electrode of the triac. The sensor circuits 42 are described still more exactly further below with reference to the FIG. 3.

If a transition is to be made from the first switching state of the setting unit 34, shown in FIG. 2, into the second or from the second switching state into the first, then the previously closed switch 37 or 38 must be opened and the previously opened switch 38 or 37 closed a short time later. In that case, the output voltage $U_A$ of the setting unit 34 shall pass over as rapidly as possible from the old to the new amplitude value without the occurrence of additional voltage peaks or voltage troughs. In order to attain this, it is expedient to open the previously closed switch 37 or 38 when the current flowing through the associated winding 35 or 36 displays a zero transition. If one uses a triac as switch 37 or 38, then this opening of the switch results at the correct instant, i.e. during the zero transition of the current, automatically thereby, that one prevents a renewed ignition in the other direction after the self-extinction of the triac during the current zero transition. The closing of a previously opened switch 38 or 37 takes place preferably at such phase angles of the magnetic flux passing through the winding 9, at which the change in this magnetic flux effected by the closing of the switch 38 or 37 is as small as possible. The phase angle of the magnetic flux, at which this criterion is fulfilled, depends on the load current so that no exact value, but only a range lets itself be given for it. For the switch 37, this range lies in the neighbourhood of the zero transition of the magnetic flux, whilst for the switch 38, it lies in the neighbourhood of the maximum of the absolute amount of this magnetic flux.

For the determination of the respectively most favourable closing instants for the switch 37 or 38, the transformer 8 possesses a fourth winding which acts as sensor winding 43. A voltage, which possesses a constant phase displacement independent of the load relative to the magnetic flux in the winding 9, is induced in this sensor winding when the switches 37 and 38 are opened. This phase displacement is constant and equal to 90° so that the switch 37 must thus always be closed in the region of the maximum of the absolute amount of this voltage and the switch 38 in the region of a zero transition of this voltage. The information data required for this are fed from the winding 43 by way of the lines 44 to the switch control 23.

Figure 3:
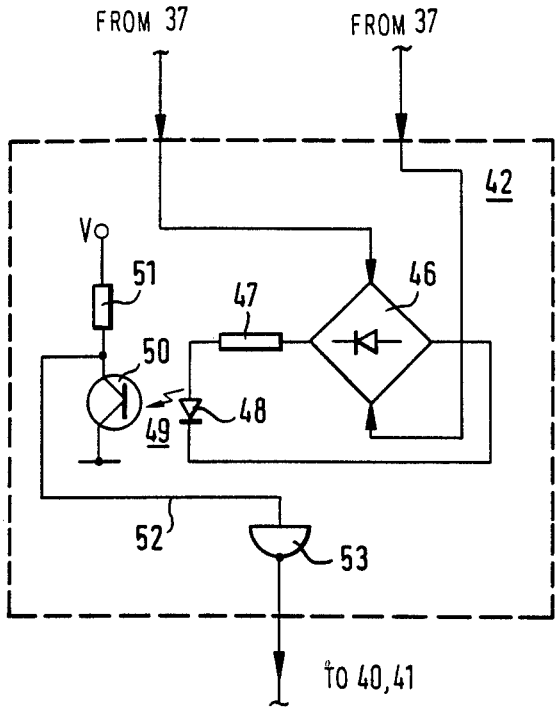

An example of the sensor units 42, illustrated only schematically in FIG. 2, is explained in the following with the aid of FIG. 3. Reproduced in that case in FIG. 3 are only both the connecting lines to the setting unit 34, which from above feed the voltage dropping across the associated switch, for example across the switch 37, as well as the line which from below delivers the driving signal for both the AND-gates of the other switches, for example for the AND-gates 40 and 41 of the switches 38, 31 and 32.

The alternating voltage, which drops across the switch 37 in the opened state, is rectified with the aid of a rectifier 46, the direct voltage outputs of which are connected each with the other through a resistor 47 and a photodiode 48 of an optical coupler 49. A photo-transistor 50 of the optical coupler 49 is connected on the one hand by way of a resistor 51 with a supply voltage V and on the other hand directly to ground. The voltage, which is tappable between the collector of the photo-transistor 50 and the resistor 51 relative to ground, is conducted by way of a line 52 to an inverter 53, the output of which is connected with the output line leading to the AND-gates 40 and 41, which can free or block the closing signals which come by way of the lines 26 and 27 from the switch control 23.

When the switch 37 is opened, then the rectifier 46 produces a direct voltage, which brings the diode 48 of the optical coupler 49 to light up, from the alternating voltage dropping across the switch 37. The "low" signal thereupon delivered by the photo-transistor 50 is inverted by the inverter 53 into an "high" signal which frees the AND-gates 40 and 41.

When thereagainst the switch 37 is closed, then no alternating voltage drops across it and the rectifier 46 produces no direct voltage. Thereby, the diode 48 of the optical coupler does not light up and the photo-transistor 50 delivers a "high" signal which is inverted by the inverter 53 into a "low" signal for the blocking of the AND-gates 40 and 41.

Figure 4:
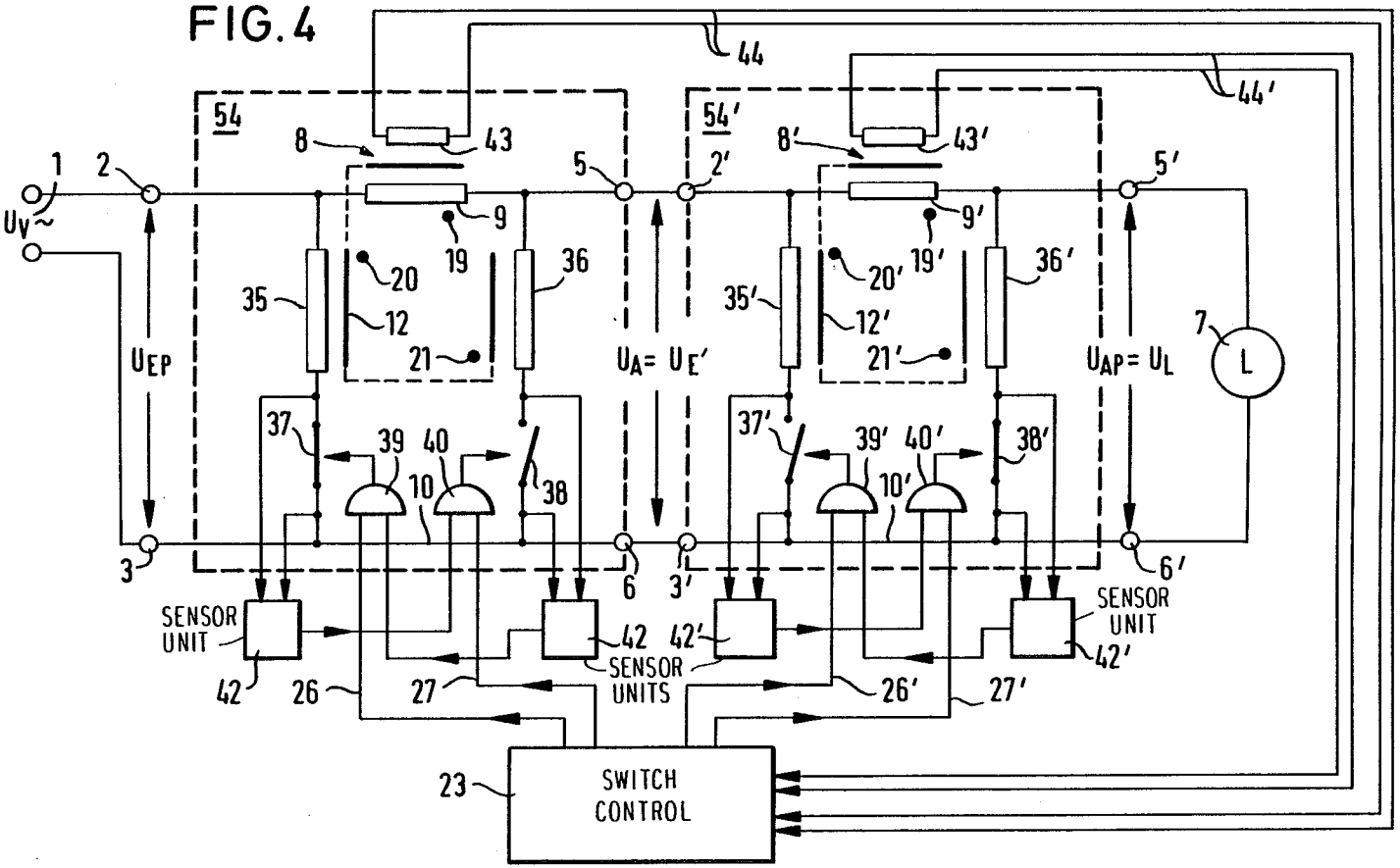

Illustrated in FIG. 4 are two setting units 54 and 54', which possess an identical build-up which differs from the build-up of the setting unit 34 illustrated in FIG. 2 merely in that both the short-circuit switches 31 and 32 are omitted. Becoming redundant as consequence hereof is also the AND-gate 41 of FIG. 2, which drives both these switches 31 and 32, as well as that one of the three sensor units 42, which interrogates the switching state of the switches 31 and 32. Both the remaining AND-gates 39 and 40 accordingly need only two instead of three signal inputs. For the remainder, the basic build-up of the setting units 54 and 54' is the same as that of the setting unit 34 and the mutually corresponding parts are provided with the same reference symbols.

Both the setting units 54 and 54' are connected in series each with the other, i.e. the output voltage $U_A$ appearing at the output terminals 5 and 6 of the setting unit 54 is fed as input voltage $U_E'$ directly to the input terminals 2' and 3' of the setting unit 54'. Since moreover the supply voltage $U_V$ delivered by the voltage source 1 is fed as input voltage to the input terminals 2 and 3 of the setting unit 54 and the output voltage delivered at the output terminals 5' and 6' of the setting unit 54' is applied as load voltage $U_L$ to the load 7, both the first windings 9 and 9' of both the transformers 8 and 8' lie in series with the load 7 as seen from the voltage source.

The fact that both the setting units 54 and 54' possess no short-circuit switches means that each of them can be brought into only three of the above defined four switching states. If one disregards the fourth switching state, which comes into question only for the emergency of a load short-circuit and in which the switches 37, 38, 37' and 38' are all opened, then only both the first switching states, into which they can be brought independently each of the other, remain as operational switching states for each of both the setting units 54 and 54'.

Thereby, four switching state combinations result altogether for the transformer circuit illustrated in FIG. 4.

Because of the absence of the respective third switching state, each of both the setting units 54 and 54' can pass on the input voltage $U_E$ and $U_E'$ respectively fed to it only with changed amplitude, i.e. either with an additively or a substractively imposed voltage change $+\Delta U_1$ or $-\Delta U_2$ or $+\Delta U_1'$ or $-\Delta U_2'$. Since the turns ratios of the further windings 35, 36, 35' and 36' to the respectively associated first winding 9 and 9' can in principle be fixed independently one of the other, four different load voltages $U_L$ let themselves bew produced altogether for a given supply voltage $U_V$.

Preferably, these turns ratios are however so fixed for the formation of a setting unit pair that the percentage increase in the output voltage $U_{AP}$ of the pair relative to the input voltage $U_{EP}$ of the pair, which results when the switches 37 and 37' are closed, to equal to the percentage reduction in the output voltage $U_{AP}$ relative to the input voltage $U_{EP}$, which results when the switches 38 and 38' are closed, and that the output voltage $U_{AP}$ is equal to the input voltage $U_{EP}$ with great accuracy when the switches 37 and 38' are closed, thus the front setting unit 54, i.e. disposed nearer to the voltage source 1, is disposed in the first switching state and the rear setting unit 54' in the second switching state. In this special switching state combination, the effects of both the setting units 54 and 54' thus mutually cancel approximately so that the alternating voltage delivered from the voltage source 1 lies practically unchanged at the load 7. In that case, it is of particular significance that this unchanged onward transmission of the input voltage of the setting unit pair to the output takes place nearly free of loss so that an efficiency of more than 99% lets itself be attained even when one connects several such setting unit pairs one behind the other.

The setting unit pair thus possesses four switching state combinations, of which three correspond to the three switching states of the above described individual setting units 4 and 34, respectively:

$$\begin{aligned} U_{AP1} &= U_{EP} + \Delta U_1 + \Delta U_1' \\ &= U_{EP} + \Delta U_P \\ U_{AP2} &= U_{EP} - \Delta U_2 - \Delta U_2' \\ &= U_{EP} - \Delta U_P \\ U_{AP3} &= U_{EP} + \Delta U_1 - \Delta U_2' \\ &= U_{EP} \end{aligned}$$

The fourth switching state combination in that case remains unused. In respect of the switching possibilities, the function of such a setting unit pair 54 and 54' is thus practically equal to the function of a single setting unit 4 or 34.

A setting unit pair however affords the advantage that, for a given magnitude of the voltage to be imposed and thereby of the power to be switched, each of both the setting unit pairs needs to manage only half of this switching power and can therefore be dimensioned to be correspondingly smaller. Although one needs one more transformer, yet for the same switching power, both the transformers 8 and 8' of the setting unit pairs 54 and 54' together are only little greater and heavier than the one transformer 8 of a setting unit 4 or 34. An individual setting unit 54 or 54' is in all cases appreciably smaller and lighter than a setting unit 4 or 34, i.e. smaller and lighter sub-units result, which brings appreciable constructional advantages in arrangements, in which a plurality of such setting units or setting unit pairs is connected one behind the other. The transport, too, is much simpler when one can disassemble such a plant into several sub-units which are each smaller and lighter. Two smaller units beyond that afford the advantage that they lead to smaller losses than a single unit with equal switching power.

For the attainment of especially high switching-over velocities such setting unit pair comprises two setting units 174, 174' as they will be described below with reference to FIG. 9.

Figure 5:
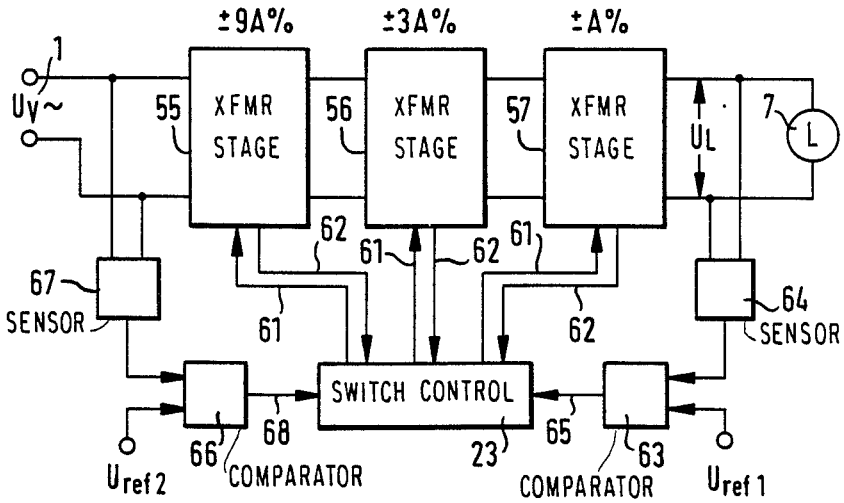

Illustrated in FIG. 5 is a transformer circuit, which serves as single-phase voltage stabiliser for the voltage $U_L$ fed to the load 7. It is in that case presumed that a target values $S_L$, which in the following is made equal to 100% and from which the actual voltage applied to the load 7 may deviate maximally by $\pm\delta\%$ is predetermined for the amplitude of the alternating voltage fed to the load 7. It is furthermore assumed that the supply voltage $U_V$ delivered by the alternating voltage source 1 can deviate in its amplitude by $\pm\Delta\%$ from the nominal value $U_{Vnenn}$. In that case, the target value $S_L$ of the load voltage $U_L$ can in principle be equal to the nominal value $U_{Vnenn}$ of the supply voltage $U_V$ or different from this nominal value. It represents a particular advantage of the transformer circuit according to the invention that it readily makes possible to regulate the load voltage $U_L$ also to a target values $S_L$, which for example lies at or in the proximity of the limit of the provided regulating range. This is however expedient only when deviations of the supply voltage can occur in only one direction. If the supply voltage is for example produced with the aid of an inverter from a battery arrangement, then this prerequisite is readily given, since the direct voltage of the battery and thereby also the amplitude of the alternating voltage produced herefrom can only decrease, but not increase during longer operation with progressive discharge of the battery arrangement.

In the following, however, the first case ($U_{Vnenn}=S_L$) is considered and it is assumed that $\Delta$ is much greater than $\delta$ so that a regulation of the amplitude of the supply voltage $U_V$ to the target value $S_L$ is required.

Figure 8:
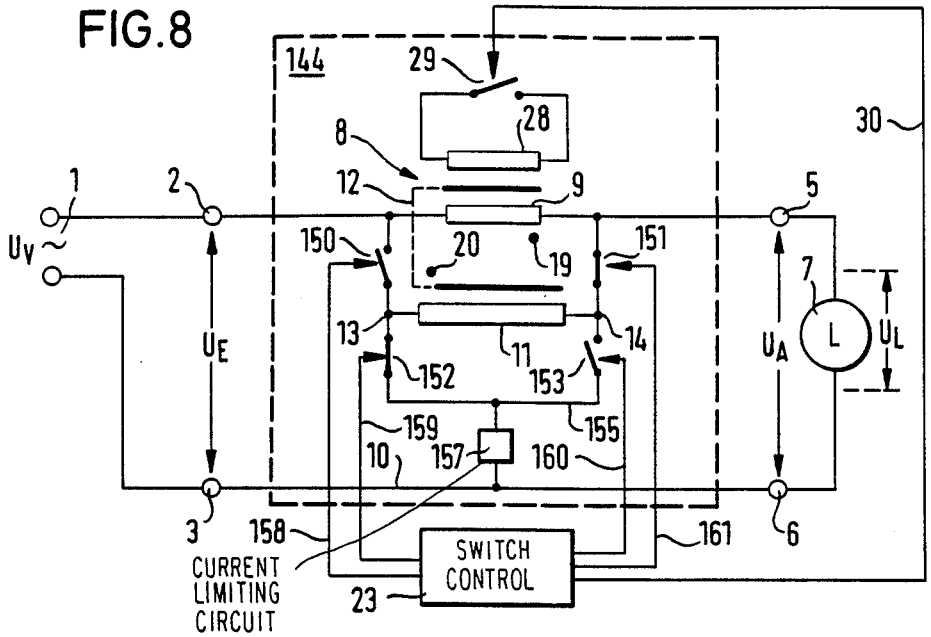
Figure 9:
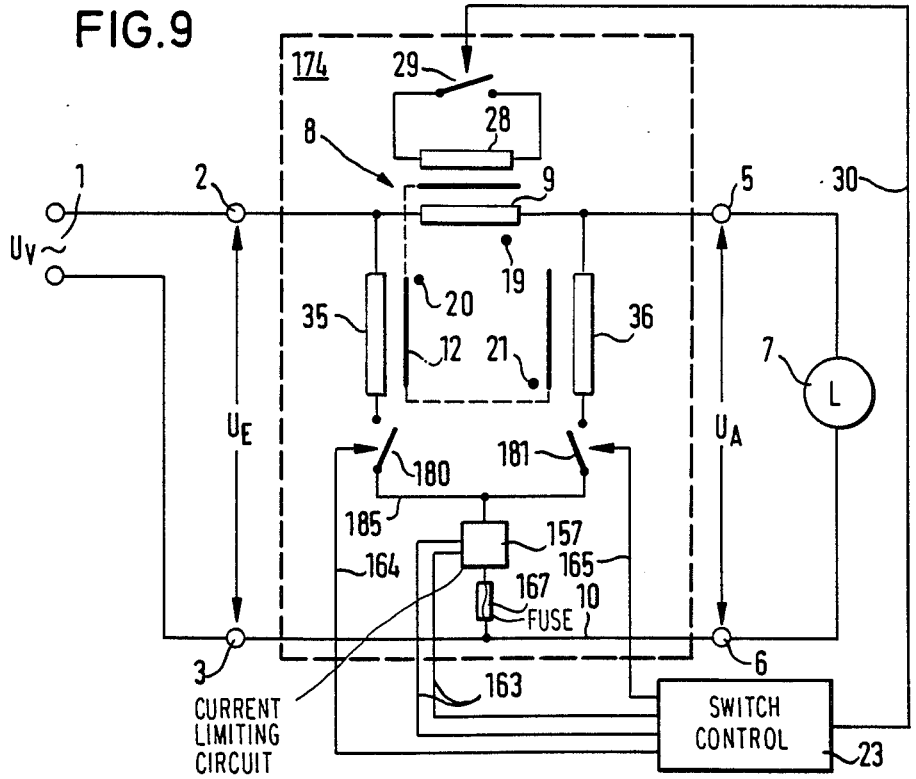

For this purpose, a transformer circuit according to the invention is provided between the voltage source 1 and the load 7 and consists of three stages 55, 56 and 57 which are connected in series one with the other and of which each can be formed either by a setting unit 4, 34, 144 or 174 according to FIGS. 1, 2, 8 or 9 or by a setting unit pair 54 and 54' according to FIG. 4 or by a setting unit pair comprising two setting units 174, 174' according to FIG. 9. The control of the stages 55, 56 and 57 takes place with the aid of a switch control 23, which is connected by way of a line pair 61 and 62 with each stage 55, 56 and 57. These line pairs symbolise, according to whether the stages 54, 55 and 57 are formed by a setting unit 4, a setting unit 34, a setting unit 144, a setting unit 174, a setting unit pair 54 and 54' or a setting unit pair 174, 174', the lines 25, 26, 27 and 30 (see FIG. 1), the lines 25, 26, 27 and 44 (see FIG. 2), the lines 158, 159, 160, 161 and 30 (see FIG. 8), the lines 163, 164, 165 and 30 (see FIG. 9), the lines 26, 27, 44, 26', 27' and 44' (see FIG. 4) or twice the lines 163, 164, 165 and 30 (see FIG. 9).

The switch control 23 delivers the switch commands by way of the lines 61 to the switches of the stages 55, 56 and 57 and by way of the lines 62 receives the information, produced by the sensor windings 43, about the phase position of the magnetic flux in the first windings 9 of the transformers 8 and thereby about the favourable closing instants or closing time spans for the switches. Furthermore, a first comparator 63 is provided, which at one of both its inputs receives a reference voltage $U_{ref1}$, which represents the target value $S_L$ for the load voltage $U_L$. Fed to the other one of both its inputs is the output signal of a first measuring sensor 64, which measures the load voltage $U_L$. The comparator 63 gives a difference signal by way of the line 65 to the switch control 23, which signal indicates whether and how far the load voltage $U_L$ deviates from the target value $S_L$. Before this deviation runs out of the permissible range $\pm\delta\%$, the switch control 23 alters the switching states of the stages 55, 56 and 57, which thereupon impose a new amplitude change on the supply voltage $U_V$ and thereby keep the load voltage $U_L$ within the permissible regulating range $\pm\delta\%$. Beyond that, a second comparator 66 is provided, which compares a reference voltage $U_{ref2}$ corresponding to the nominal value $U_{Vnenn}$ of the supply voltage $U_V$ with the output of a second measuring sensor 67, which measures just this supply voltage $U_V$. The difference signal delivered by the second comparator 66 is fed by way of the line 68 likewise to the switch control 23, which thus can operate not only in the regulating mode, but also in the control mode or in a combination of both. This affords the advantage that in the case of a short-circuit on the load side, i.e. in the case of $U_L=0$, the switch control can recognise the fault case from the fact that $U_V$ is just as before different from zero and does not attempt to regulate up the load voltage $U_L$. Instead thereof, it can bring the setting units of all stages into the above defined switching state, in which the first windings 9 of all transformers 8 exert a strong choke effect and thereby limit the load short-circuit current. The switch control 23 preferably comprises a microprocessor for the processing of the information data coming in by way of the lines 62, 68 and 65 and for the translation of these information data into corresponding switch commands.

As already mentioned, the stages 55, 56 and 57 are so built up that each state increases the input voltage fed to it by a predetermined percentage in a first switching state or in a first switching state combination, decreases it by about the same percentage in a second switching state or in a second switching state combination and passes it on about unchanged in a third switching state or a third switching state combination. In this sense, switching state combinations are also simply designated in the following at first, second and third switching state respectively whenever setting unit pairs are not explicitly under discussion.

The predetermined percentages, by which the individual stages can change the respectively supplied input voltage, are different from stage to stage and preferably stand in about the ratio of whole number powers of three one to the other. Thus, in the example of embodiment shown in FIG. 5, the last stage 57, which lies nearest to the load 7, can change the input voltage fed to it for example by $\pm A\%$ or pass it on nearly unchanged. The middle stage 57 can change the input voltage fed to it by about $\pm 3A\%$ or pass it on nearly unchanged and the foremost stage 55, lying nearest to the voltage source, can change the input voltage fed to it by about $\pm 9A\%$ or pass it on nearly unchanged.

For an example of embodiment, in which each stage 55, 56 and 57 is formed by a setting unit pair 54 and 54' or 174, 174', respectively is illustrated once again more exactly in table 3 for the case that $\pm A\%$ is chosen to be approximately equal $\pm 1\%$ so that for the setting unit pair of the middle stage 56, there results a possible amplitude change of about $\pm 3\%$ of the input voltage fed to this pair and a possible amplitude change of about $\pm 9\%$ for the setting unit pair of the foremost stage 55.

As is evident from the Table 3, it is expedient for the attainment of as symmetrical as possible a change of the respective input voltage of a setting unit pair to choose the percentage voltage changes attainable by the individual further windings to be at least partially different.

Thus, it applies for the pair of the foremost stage 55 or 174, respectively, that the additive winding of the setting unit 55 is capable of effecting a change of $+4.5\%$, while the subtractive winding can effect a change of $-4\%$ and the additive and subtractive winding, respectively, of the setting unit 54' or 174', respectively, can impose a change of $+4.4\%$ or $-4.2\%$ on the input voltage of this rear setting unit 54' or 174', respectively, of the stage 55.

TABLE 3

| | | | Switching state combination | | |
|---|---|---|---|---|---|
| | | | 1 both additive windings in | 2 both subtractive windings in | 3 "front" additive and "rear" subtractive winding in |
| Setting unit 54 or 174 | additive winding | +4.5% | | | |
| 1. Stage 55 | subtractive winding | −4.9% | | | |
| Setting unit 54' or 174' | additive winding | +4.4% | +9.1% | −8.9% | +0.1% |
| | subtractive winding | −4.2% | | | |
| Setting unit 54 or 174 | additive winding | +1.5% | | | |
| 2. Stage 56 | subtractive winding | −1.55% | | | |
| Setting unit 54' or 174' | additive winding | +1.5% | +3.02% | −2.98% | +0.03% |
| | subtractive winding | −1.45% | | | |
| Setting unit 54 or 174 | additive winding | +0.5% | | | |
| 3. Stage 57 | subtractive winding | −0.5% | +1.0% | −1.0% | +0.0% |
| Setting unit 54' or 174' | additive winding | +0.5% | | | |
| | subtractive winding | −0.5% | | | |

These percentage values are so chosen by a corresponding choice of the turns ratios that for the three used switching states of the first stage, the total changes result, which amount to +9.1%, −8.9% and +0.1% and are reproduced at the right in table 3. These three values are chosen to be higher by 0.1% than the aimed at +9%, −9% and 0%. Hereby, the voltage drop is compensated for, which results on the flowing of the load current by reason of the remaining choke effect at the concerned first windings of both these setting units 54 and 54' or 174, 174', respectively.

The corresponding applies also for the stage 56 with values which are higher by about 0.02% to 0.03% as one can readily infer from the table 3.

Listed in table 4 are, similarly as in table 2 at the left, once again the twenty-seven switching state combinations, which let themselves be attained by a transformer circuit according to FIG. 5 and comprising three setting unit pairs, when only three switching state combinations are used for each setting unit pair. There-besides, it is reproduced in table 4 for each setting unit 54 and 54' of the three setting unit pairs whether the additive or the subtractive winding is connected to the associated input voltage and output voltage, respectively. A "1" means that the concerned further winding is connected to the associated voltage, whilst a "0" indicates that the winding has been separated from the terminal connecting conductor 10 (see FIG. 4) through opening of the concerned switch 37, 37', 38 or 38' and is thereby not connected to the input voltage or output voltage. The number combination 1001 for a setting unit pair thus means that the additive winding is switched on in the front setting unit, i.e. that lying nearer to the voltage source 1, and the subtractive winding is switched off, whilst the additive winding is switched off and the subtractive winding is switched on for the rear setting unit arranged nearer to the load 7. A setting unit pair so characterized is thus disposed in the above defined third switching state combination, in which the windings of the front and the rear setting unit practically cancel mutually so that the output voltage appears with nearly unchanged amplitude at the output of the setting unit pair.

TABLE 4

| Change | ±9% | | | | ±3% | | | | ±1% | | | | |
|---|---|---|---|---|---|---|---|---|---|---|---|---|---|
| Setting unit | 54 | | 54' | | 54 | | 54' | | 54 | | 54' | | $\frac{U_L}{U_V}$ |
| Winding | + | − | + | − | + | − | + | − | + | − | + | − | |
| Combination | | | | | | | | | | | | | |
| n = 0 | 1 | 0 | 0 | 1 | 1 | 0 | 0 | 1 | 1 | 0 | 0 | 1 | 1,0014 |
| n = 1+ | 1 | 0 | 0 | 1 | 1 | 0 | 0 | 1 | 1 | 0 | 1 | 0 | 1,0114 |
| n = 2+ | 1 | 0 | 0 | 1 | 1 | 0 | 1 | 0 | 0 | 1 | 0 | 1 | 1,0210 |
| n = 3+ | 1 | 0 | 0 | 1 | 1 | 0 | 1 | 0 | 1 | 0 | 0 | 1 | 1,0313 |
| n = 4+ | 1' | 0 | 0 | 1 | 1 | 0 | 1 | 0 | 1 | 0 | 1 | 0 | 1,4016 |
| n = 5+ | 1 | 0 | 1 | 0 | 0 | 1 | 0 | 1 | 0 | 1 | 0 | 1 | 1,0479 |
| n = 6+ | 1 | 0 | 1 | 0 | 0 | 1 | 0 | 1 | 1 | 0 | 0 | 1 | 1,0585 |
| n = 7+ | 1 | 0 | 1 | 0 | 0 | 1 | 0 | 1 | 1 | 0 | 1 | 0 | 1,0691 |
| n = 8+ | 1 | 0 | 1 | 0 | 1 | 0 | 0 | 1 | 0 | 1 | 0 | 1 | 1,0804 |
| n = 9+ | 1 | 0 | 1 | 0 | 1 | 0 | 0 | 1 | 1 | 0 | 0 | 1 | 1,0913 |
| n = 10+ | 1 | 0 | 1 | 0 | 1 | 0 | 0 | 1 | 1 | 0 | 1 | 0 | 1,1022 |
| n = 11+ | 1 | 0 | 1 | 0 | 1 | 0 | 1 | 0 | 0 | 1 | 0 | 1 | 1,1127 |
| n = 12+ | 1 | 0 | 1 | 0 | 1 | 0 | 1 | 0 | 1 | 0 | 0 | 1 | 1,1239 |
| n = 13+ | 1 | 0 | 1 | 0 | 1 | 0 | 1 | 0 | 1 | 0 | 1 | 0 | 1,1352 |
| n = 1− | 1 | 0 | 0 | 1 | 1 | 0 | 0 | 1 | 0 | 1 | 0 | 1 | 0,9914 |
| n = 2− | 1 | 0 | 0 | 1 | 0 | 1 | 0 | 1 | 1 | 0 | 1 | 0 | 0,9810 |
| n = 3− | 1 | 0 | 0 | 1 | 0 | 1 | 0 | 1 | 1 | 0 | 0 | 1 | 0,9713 |

TABLE 4-continued

| Change | ±9% | | | | ±3% | | | | ±1% | | | | |
|---|---|---|---|---|---|---|---|---|---|---|---|---|---|
| Setting unit | 54 | | 54' | | 54 | | 54' | | 54 | | 54' | | $\frac{U_L}{U_V}$ |
| Winding | + | − | + | − | + | − | + | − | + | − | + | − | |
| n = 4− | 1 | 0 | 0 | 1 | 0 | 1 | 0 | 1 | 0 | 1 | 0 | 1 | 0,9616 |
| n = 5− | 0 | 1 | 0 | 1 | 1 | 0 | 1 | 0 | 1 | 0 | 1 | 0 | 0,9480 |
| n = 6− | 0 | 1 | 0 | 1 | 1 | 0 | 1 | 0 | 1 | 0 | 0 | 1 | 0,9386 |
| n = 7− | 0 | 1 | 0 | 1 | 1 | 0 | 1 | 0 | 0 | 1 | 0 | 1 | 0,9292 |
| n = 8− | 0 | 1 | 0 | 1 | 1 | 0 | 0 | 1 | 1 | 0 | 1 | 0 | 0,9204 |
| n = 9− | 0 | 1 | 0 | 1 | 1 | 0 | 0 | 1 | 1 | 0 | 0 | 1 | 0,9113 |
| n = 10− | 0 | 1 | 0 | 1 | 1 | 0 | 0 | 1 | 0 | 1 | 0 | 1 | 0,9022 |
| n = 11− | 0 | 1 | 0 | 1 | 0 | 1 | 0 | 1 | 1 | 0 | 1 | 0 | 0,8928 |
| n = 12− | 0 | 1 | 0 | 1 | 0 | 1 | 0 | 1 | 1 | 0 | 0 | 1 | 0,8839 |
| n = 13− | 0 | 1 | 0 | 1 | 0 | 1 | 0 | 1 | 0 | 1 | 0 | 1 | 0,8751 |

In the combination n=0, all three setting unit pairs are disposed in the just described state and it is evident from the extreme righthand column of the table 4 that the ratio of load voltage $U_L$ to the supply voltage $U_V$ is in this case equal to 1.0014, thus practically equal to 1.

Thereagainst, for example at n=13+, all three setting unit pairs are in a state, in which the additive winding is switched on in both setting units (first switching state combination characterised by 1010). It is evident from the righthand column that the load voltage $U_L$ is here greater by 13.52% than the supply voltage $U_V$.

The switch control 23 selects this conbination when the supply voltage $U_V$ has fallen greatly relative to the target value.

If one assumes that the deviation $\pm\delta\%$ of the load voltage from the target value S, which is here set equal to 100%, may maximally amount to ±0.5%, then the supply voltage $U_V$ can fall to 87.65% of this target value, because the transformer circuit according to the invention can raise this fallen supply voltage $U_V$ by 13.52% (referred to $U_V$=100%); the resulting value for the load voltage of $$\begin{aligned} U_L &= U_V \cdot 1.1352 \\ &= 87.65 \cdot 1.1352\% \\ &= 99.5\% \text{ (referred to the target value)} \end{aligned}$$

lies at the lower limit of 99.5% (referred to the target value) and thus within the permissible range.

For the switching state combination n=13−, it applies correspondingly that the supply voltage $U_V$ can here have risen to 114.84% of the target value without the load voltage $$\begin{aligned} U_L &= U_v \cdot 0.8751 = \\ &= 114.84 \cdot 0.8751 = \\ &= 100.496\% \text{ (refferred to the target value)} \end{aligned}$$

exceeding the upper limit of 100.5% of the permissible range.

The corresponding lets itself be attained for all remaining switching state combinations n. In that case, a transition is made from one switching state combination to the next preferably always at such values of the supply voltage $U_V$, at which the amplitude of the load voltage $U_{Lvor}$ before the switching and the amplitude of the load voltage $U_{Lnach}$ after the switching lie about symmetrically to the target value $S_L$ (see above equation (14)). It results from the above values that fluctuations in the supply voltage $U_V$ of $+\Delta=+14.84\%$ (referred to the target value S=100%) to $-\Delta=-13.35\%$ (likewise referred to S=100%) can in this example of embodiment be so compensated for that the load voltage $U_L$ fluctuates only within a range of S±0.5%.

The corresponding applies also, albeit within limits, when the stages 55, 56 and 57 are formed by a setting unit comprising two setting units 174, 174' according to FIG. 9, or by individual setting units 4, 34 or 144.

If a greater fluctuation range $\pm\Delta\%$ is to be covered, either the minimum amplitude change A must be increased, which is at the cost of the regulating accuracy δ, or the number of the stages must be increased. In that case, it can be expedient to add a stage, the change range of which is not equal to the next whole number power of three of A, thus here not equal to ±27A, but amounts to only a whole number multiple smaller than 27 of A, which is so great that when all four stages act in the same direction, i.e. all additively or all subtractively, the required fluctuation range ±Δ can just be covered.

Figure 6:
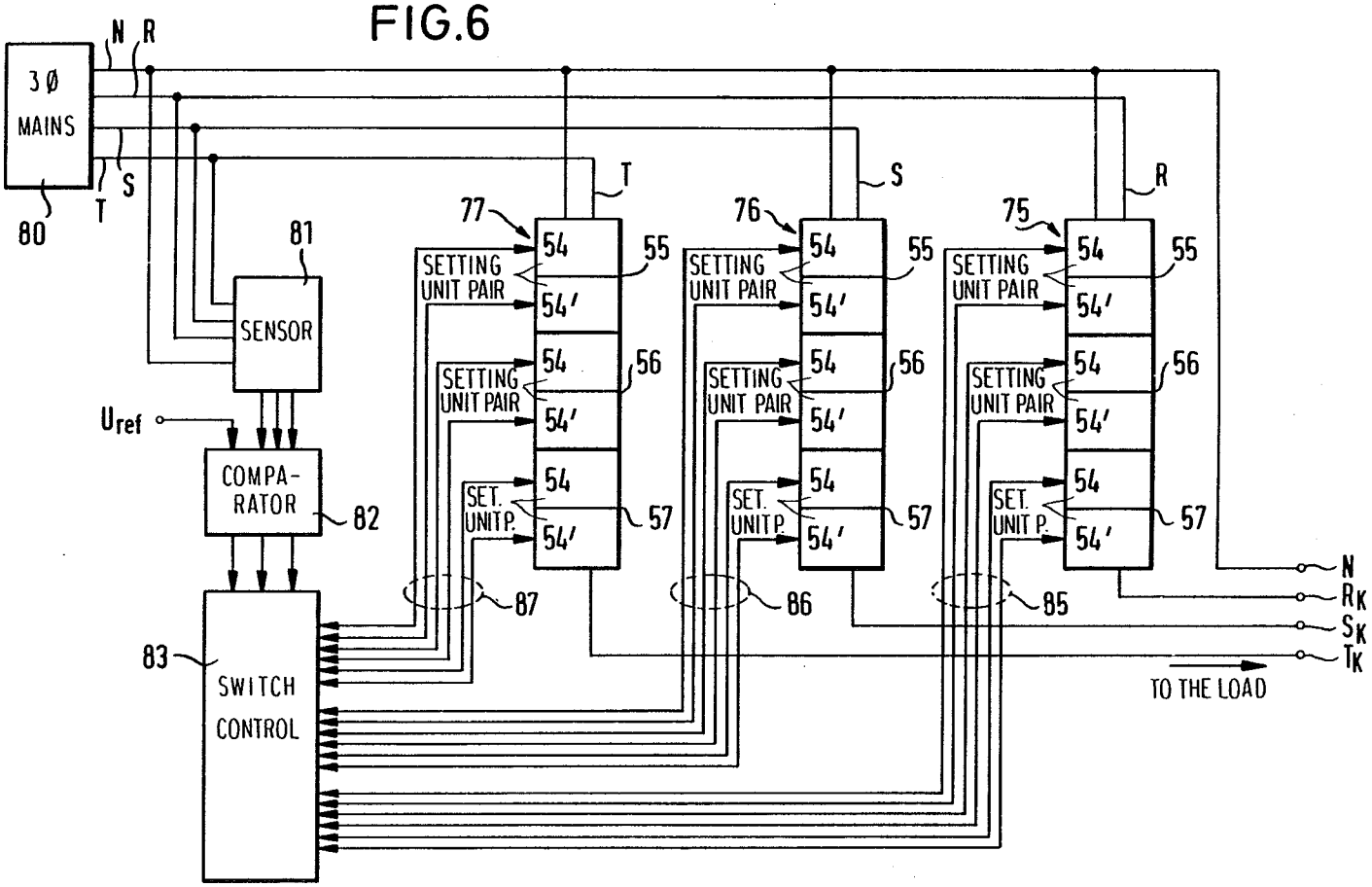

FIG. 6 shows a modification of the circuit arrangement according to the invention as it can find use for the control of the voltage delivered by a three-phase mains.

As is evident from the FIG. 6, for each of the three phase conductors R, S and T, there is provided a respective transformer circuit 75, 76 and 77, according to the invention, each time built up in the same manner as the transformer circuit in FIG. 5. Thus, each of these three transformer circuits 75, 76 and 77 consists of three stages 55, 56 and 57, which are connected in series and of which each here consists of a setting unit pair 54 and 54' or 174, 174', respectively, and can assume four different switching states. Thus, amounts of change, which stand in the ratio of 1:3:9 one to the other, can be imposed on each of the three phase conductors R, S and T or the alternating input voltage can be passed on unchanged or the load current can be choked.

In order to be able to bring the stages of the transformer circuits 75, 76 and 77 into the three different switching states in the required manner, each of the transformer circuits 75, 76 and 77 is connected not only with its associated phase conductor R, S and T, respectively, but also with the neutral conductor N. A three-phase mains 80 serves as voltage source here.

The voltage amplitudes delivered by the mains 80 on the individual phase conductors R, S and T are constantly measured with the aid of a measuring sensor arrangement 81, which feeds the three measurement signals to a comparator arrangement 82. There, the measurement signals are compared with a common reference value $U_{ref}$. Alternatively, an individual reference value can also be predetermined for each phase conductor R, S and T.

The comparator 82 produces an individual difference signal, which is fed to a switch control 83, for each of the three phase conductors R, S and T. This switch control controls the switches of the stages 55, 56 and 57 in each of the transformer circuits 75, 76 and 77 by way of the line groups 85, 86 and 87 in the manner as was explained in detail above. Of course, each setting unit is also here connected by way of several lines with the switch control 83, as is illustrated in the FIGS. 1, 2, 4, 8 and 9. For the sake of simplicity, these lines were however illustrated only as a single bidirectional line in FIG. 6.

A phase conductor $R_K$, $S_K$ and $T_K$ respectively forms the output of each transformer circuit 75, 76 and 77, wherein the letter "K" indicates that an alternating voltage with an amplitude, which is kept constant, stands at disposal on these phase conductors. These voltages can be fed either together to a single load requring a three-phase current or to different loads which each need be operated only by a single-phase alternating current.

Alternatively, the measuring sensor arrangement 81 can also be so constructed in a multi-phase system that it measures the alternating voltages fed to the load or loads on the phase conductors $R_K$, $S_K$, and $T_K$.

In case of greater demands on the regulating accuracy or for still greater regulating ranges, more than three stages can be provided also in the transformer circuits 75, 76 and 77. Analogously to FIG. 6, the circuit arrangement according to the invention can be used also in multi-phase systems which comprise more or fewer than three phases.

Figure 7:
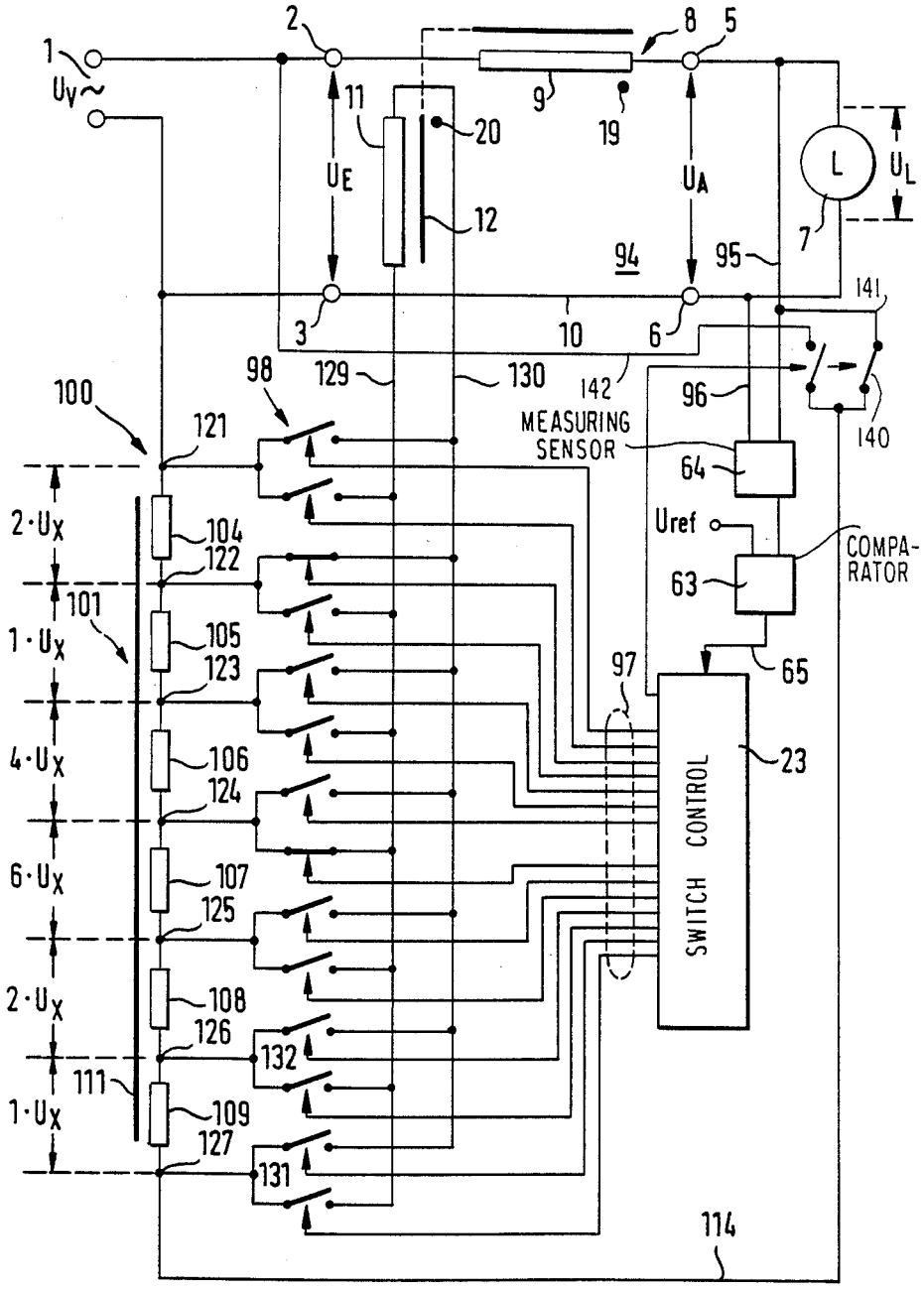

Illustrated in FIG. 7 is a further embodiment of a transformer circuit according to the invention, which comprises only a single setting unit 94. As for the example of embodiment illustrated in FIG. 1, a supply voltage $U_V$, which orginates from a voltage source 1, is fed also here as input voltage $U_E$ to the input terminals 2 and 3 of the setting unit 94. An output voltage $U_A$, which is fed as load voltage $U_L$ to a load 7, appears at the output terminals 5 and 6. Furthermore, the setting unit 94 comprises a transformer 8, the first winding 9 of which is connected between the input terminal 2 and the output terminal 5, whilst the other input terminal 3 is connected directly with the second output terminal 6 by means of the terminal connecting conductor 10 in galvanically conducting manner. The transformer 8 also possesses a further winding 11, which is magnetically coupled by way of the iron core 12 of the transformer 8 with the first winding 9.

By contrast to the example of embodiment in FIG. 1, the setting unit 94 of the present example of embodiment can however be brought not only into four, but into thirty-four different switching states so that it is possible to produce altogether thirty-two different amplitude differences between the input voltage $U_E$ and the output voltage $U_A$ of the one setting unit 94, to put the input voltage $U_E$ at disposal unchanged at the output terminals 5 and 6 or to choke the load current in the case of a short-circuit at the load.

This great possibility of variation permits the transformer circuit illustrated in FIG. 7 to be used as voltage regulator and/or voltage stabiliser similarly as the transformer circuits in the FIGS. 5 and 6.

Illustrated in FIG. 7 is the case of application as voltage regulator, in which the output voltage $U_A$, which is here equal to the load voltage $U_L$, of the setting unit 94 is once again conducted by way of lines 95 and 96 to a measuring sensor arrangement 64. The measuring sensor 64 passes a measurement signal on to a comparator 63, which compares this measurement signal with a reference voltage $U_{ref}$, which corresponds to the target value $S_L$ of the load voltage $U_L$. The comparator 63 passes a difference signal, which represents the difference between the measurement signal and the reference voltage $U_{ref}$, by way of the line 65 onto a switch control 23, which by way of lines 97 drives a switch group 98 consisting of fourteen switches in order to bring the setting unit 94 into the different switching states as is explained still more exactly in the following.

In order to be able to bring the setting unit 94, apart from both the switching states, in which the further winding 11 is either short-circuited or completely open, into thirty-two further switching states, thirty-two control voltages $U_{S1}$ to $U_{S32}$, which according to the invention are produced with the aid of a single alternating voltage source 100, must be applied to the further winding 11.

The alternating voltage source 100 is formed by an auxiliary transformer arrangement 101, which in the present case consists of six winding portions 104 to 109, which are connected electrically in series one with the other and coupled magnetically one with the other by way of a common transformer core 111.

The one end of the series connection consisting of the winding portions 104 to 109 is connected in galvanically directly conducting manner with the one pole of the alternating voltage source 1, to which also the input terminal 3 of the setting unit 94 is connected, which is connected by way of the terminal connecting conductor 10 in galvanically directly conducting manner with the output terminal 6 of the setting unit 94. The other end of the series connection consisting of the winding portions 104 to 109 is connected by way of a line 114 with two switches 140 which are actuable in opposite phase and with the aid of which the end of line 114, which lies remote from the series connection of the windings 104 to 109, can be connected by way of lines 141, 142 either with the line leading from the output terminal 5 to the load 7 or with the line leading from the voltage source 1 to the input terminal 2. The switches 140 are also driven by the switch control 23 in order to apply either the input voltage $U_E$ or the output voltage $U_A$ of the setting unit 94 to the series connection of the windings 104 to 109. The first preferably takes place when a voltage $\Delta U_1, \ldots \Delta U_{31}$, which is additively imposed on the input voltage $U_E$, shall be induced in the first winding 9 through an appropriate control voltage $U_{S1}, \ldots, U_{S31}$ applied to the further winding 11. The line 114 is there against preferably connected to the output voltage $U_A$ when a voltage $\Delta U_2, \ldots, \Delta U_{32}$, which is subtractively imposed on the input voltage $U_E$, shall be induced in the first winding 9.

The series connection of the winding portions 104 to 109 displays seven taps 121 to 127, of which the taps 121 and 127 are connected with both the outer ends of the series connection, whilst the taps 122 to 126 are each led out between two mutually adjacent winding portions.

Each of the taps 121 to 127 is connected with a pair of on/off switches of the switch group 98. The one switch of each switch pair in the closed state connects the associated tap with a line 129, which is connected with the end, which is lower in FIG. 7, of the further winding 11. The other switch of each pair in the closed state connects the associated tap with a line 130, which stands in connection with the other end of the further winding 11. All switches of the switch group 98 are, as already mentioned, so driven by way of the lines 97 from the switch control 23 that the just required control voltage $U_{S1}$ to $U_{S32}$ is always present at the further winding 11 or that both the switches of any desired pair are closed at the same time in order to shortcircuit the winding 11 or that all switches 98 are opened in order to choke the load current.

For a symmetrical regulating of the load voltage $U_L$ around the target value $S_L$, the setting unit can be brought into thirty-two different switching states, of which sixteen are provided for the additive imposition of the respectively induced voltages $\Delta U_1$ to $\Delta U_{31}$ and sixteen for the negative imposition of the respectively induced voltage $\Delta U_2$ to $\Delta U_{32}$. In that case, the amplitude of each positively imposed voltage is equal to the amplitude of a corresponding negatively imposed voltage.

Since the sign of the imposition results from the winding sense, with which the further winding 11 is connected to a control voltage, only sixteen control voltages $U_{S1}$ to $U_{S16}$ of different amplitudes are thus required, since the further winding 11 can with the aid of the switch 98 be applied to the different taps 121 to 127 with two different directions of the winding sense.

In order to be able to tap the sixteen different control voltage amplitudes, the number of turns of the winding portions 104 to 109 are matched one to the other according to a code which is so optimised that a smallest possible number of winding portions 104 to 109 and thereby also of taps 121 to 127 and switches 98 is needed and that on the other hand the maximally required control voltage $U_{Smax}$ can be tapped off between the taps 121 and 127 lying furthest apart each from the other.

According to this optimised code, the winding portion 109 possesses such a number of turns that a tap voltage $1.U_{Xmin}$, which corresponds to the smallest required control voltage $U_{Smin}$, is tappable from this winding portion 109 when the output voltage $U_A$ of the setting unit 94 is present across the series connection of all winding portions 104 to 109.

Through simultaneous closing of that switch of the switch pair 132, which is the upper one in FIG. 7, and of that switch of the switch pair 131, which is the lower one in FIG. 7, the smallest required control voltage $U_{Smin}$ can thus be so applied to the further winding 11 that the voltage $\Delta U_{min}$ hereby induced in the first winding 9 of the transformer 8 is subtractively imposed on the input voltage $U_E$. If instead thereof, that switch of the pair 132, which is the lower in FIG. 7, and that switch of the pair 131, which is the upper in FIG. 7, are closed at the same time, then the same smallest control voltage $U_{Smin}$ is applied to the further winding 11, but the winding sense of the further winding 11 is inverted relative to the preceding case so that the induced voltage $\Delta U_{min}$ is now additively imposed on the input voltage $U_E$. The corresponding applies also for the control voltages tappable between any desired other taps 121 to 127.

According to the optimised code, the number of turns of the remaining winding portions 104 to 108 are so chosen that the following tap voltages each time stand at disposal between adjacent taps 121 to 126:

TABLE 5

| Pair of taps | $U_X$ |
|---|---|
| 121, 122 | $2 \cdot U_{Xmin}$ |
| 122, 123 | $1 \cdot U_{Xmin}$ |
| 123, 124 | $4 \cdot U_{Xmin}$ |
| 124, 125 | $6 \cdot U_{Xmin}$ |

TABLE 5-continued

| Pair of taps | $U_X$ |
|---|---|
| 125, 126 | $2 \cdot U_{Xmin}$ |

Together with the voltage $1.U_{Xmin}$ at the pair of taps 126 and 127, this yields the possibility of tapping all control voltage amplitudes from $1.U_{Smin}$ to $16.U_{Smin}$ either directly at immediately adjacent taps or between taps lying further apart one from the other, as is illustrated in the following table 6:

TABLE 6

| Control voltage | Taps |
|---|---|
| $1 \cdot U_{Smin}$ | 126, 127 |
| $2 \cdot U_{Smin}$ | 125, 126 |
| $3 \cdot U_{Smin}$ | 125, 127 |
| $4 \cdot U_{Smin}$ | 123, 124 |
| $5 \cdot U_{Smin}$ | 122, 124 |
| $6 \cdot U_{Smin}$ | 124, 125 |
| $7 \cdot U_{Smin}$ | 121, 124 |
| $8 \cdot U_{Smin}$ | 124, 126 |
| $9 \cdot U_{Smin}$ | 124, 127 |
| $10 \cdot U_{Smin}$ | 123, 125 |
| $11 \cdot U_{Smin}$ | 122, 125 |
| $12 \cdot U_{Smin}$ | 123, 126 |
| $13 \cdot U_{Smin}$ | 123, 127 |
| $14 \cdot U_{Smin}$ | 122, 127 |
| $15 \cdot U_{Smin}$ | 121, 126 |
| $16 \cdot U_{Smin}$ | 121, 127 |

One sees that the optimised code distinguishes itself also here thereby, that one times the minimum tap voltage $U_{Xmin}$ is tappable at the winding portion 109 lying at the one end of the series connection and that two times $U_{Xmin}$ is tappable at the winding portion 104 lying at the other end.

FIG. 8 shows again a single setting unit 144 which has a similar structure as setting unit 4 of FIG. 1 and which, in a like manner, is connected between an alternating voltage source 1 and a load 7 in order to change the amplitude of an alternating voltage. Parts of the circuitry shown in FIG. 8, which are identically present in FIG. 1, bear the same reference numerals. In FIG. 8, too, the transformer comprises one single further winding 11 which is magnetically coupled by way of the iron core 12 of the transformer 8 with the first winding 9 thereof. Two switches 150, 152 and 151, 153, respectively are connected with each of the ends 13 and 14 of the further winding 11.

When the switch 150 is closed, it connects the end 13 of the further winding 11 with the input terminal 2, with which also the one end of the first winding 9 is connected. When the switch 151 is closed, then it connects the other end 14 of the further winding 11 with the output terminal 5, with which the other end of the first winding 9 is connected.

When the switch 152 is closed, then it connects the end 13 of the further winding 11 with a line 155, by which the switch 153 in the closed state also connects the other end 14 of the further winding 11. Provided between the line 155 and the terminal connection conductor 10 is a circuit arrangement 157, which can be a simple controllable on/off switch, is preferably however formed by a current-limiting circuit as still explained more exactly further below with reference to FIG. 10.

The setting unit 144 can be brought into four different switching states with the aid of the switches 150 to 153. In the first switching state, in which the switches 150 and 153 are closed, the input voltage $U_E$ is applied to the further winding 11 and the current-limiting circuit 157 lying in series with it. Since the limit value, to which the current-limiting circuit 157 limits the current flowing through it, is chosen to be greater than the current which in this first switching state flows through the further winding 11, the voltage drop across the current-limiting circuit 157 is very small and practically the entire input voltage $U_E$ lies as control voltage at the further winding 11. The winding sense, defined by the points 19 and 20, of the windings 9 and 11 is so chosen that the voltage $\Delta U_1$, which in this first switching state is induced through the further winding 11 in the first winding 9, is added to the input voltage $U_E$. Thus, one obtains the voltage $$U_{A1}=U_E+\Delta U_1$$

between the output terminals 5 and 6 of the setting unit. The absolute amplitude amount of the induced voltage $\Delta U_1$ is thereby determined through the turns ratio $w_1/w_w$ of the first winding 9 to the further winding 11 according to the equation $\Delta U_1=w_1U_E/w_w$.

In the second switching state, which is illustrated in FIG. 8, the switches 150 and 153 are opened and the switches 151 and 152 are closed, whereby the output voltage $U_A$ of the setting unit 144 is applied to the further winding 11 and the current-limiting circuit 157 again lying in series with it. Since the current flowing through the further winding 11 in this second switching state is about equal to the current which flows through the further winding 11 in the first switching state, also this current lies below the limit value of the current-limiting circuit 157, so that its resistance also in this second switching state is very small and practically the entire output voltage $U_A$ is present at the further winding 11. The winding sense of the further winding 11 is reversed relative to the first switching state. Thereby, the voltage $\Delta U_2$, which in this second switching state is induced in the first winding 9 of the transformer 8, is subtracted from the input voltage $U_E$ so that one obtains at the output 5 and 6:

$$U_{A2}=U_E-\Delta U_2.$$

$\Delta U_2=w_1U_E/(w_w+w_1)$ applies in this case for the induced voltage. Thus, the voltage $\Delta U_2$ induced in the second switching state is somewhat smaller than the induced voltage $\Delta U_1$ induced in the first switching state.

In a third switching state of the setting unit 144, at least both the switches 150 and 151 are closed so that the further winding 11 in parallel and opposite winding sense to the first winding 9 and electrically parallel to this first winding 9 lies at the same voltage as this. The transformer 8 is thus short-circuited in this switching state and the currents, which flow in both the parallel opposed windings 9 and 11, each try to build up a magnetic field; these fields are however oppositely directed and almost cancel each other.

The stray inductance of the first winding 9 can be kept so small that the first winding 9 opposes the load current flowing through it in this switching state by only its very small ohmic resistance, whereby the voltage drop appearing across the first winding 9 is very small. This means that $U_A=U_E$ applies in this third switching state.

Only the very small voltage drop across the first winding 9 stands at disposal as driving voltage for the short-circuit current flowing through the further winding 11 so that also the short-circuit current through the further winding 11 remains very small. Since the impedance of the further winding 11 is appreciably greater than that of the first winding 9, the load current flows practically exclusively through the first winding 9.

If it is always made certain that the switches 152 and 153 are both opened when the switches 150 and 151 are closed, the current-limiting circuit 157 can be dispensed with, i.e. the conductor 155 can be connected in galvanically conducting manner directly with the terminal connection conductor 10. This has however the consequence that on the switching-over, for example, from the second switching state illustrated in the FIG. 8 into the first switching state, initially the switches 151 and 152 must be opened and that only when these switches are open with certainty, the switches 150 and 153 can be closed. If namely all four switches 150 to 153 were to be closed simultaneously in the case of absent current-limiting circuit 157, the input voltage $U_E$ as well as also the output voltage $U_A$ would be short-circuited, which would lead to impermissibly high short-circuit currents and to an undesired collapsing of these voltages.

Without a current-limiting circuit 157, on a transition from one switching state into the other, initially the previously closed switches would thus have to be opened, which would be possible only during the zero transition of the current flowing through them if one uses triacs as switches and the switches to be closed for the new switching state would then have to be closed, for which certain instants would again have to be awaited, in which least possible switching peaks in the output voltage $U_A$ result through this switching-over operation. This leads altogether thereto, that the new amplitude value stands at disposal stably at the earliest after one and a half to two periods of the alternating output voltage $U_A$.

To speed up the switch-over operations, it is therefore advantageous to provide the current-limiting circuit 157. It makes it possible during a switch-over operation, through which the setting unit is for example to be switched over out of the second switching state illustrated in FIG. 8 into the first switching state, to bring the setting unit 144 initially into the third switching state, which occurs through closing of the first switch 150. A short time later, the third switch 152 is then opened and hereupon the fourth switch 153 closed. In that case, the setting unit remains in the third switching state, since the first switch 150 and the second switch 151 are closed in this time. A short-circuiting of both the windings 9 and 11 through the further conductor 155 is avoided thereby, that both the switches 152 and 153 are not closed at the same time. During the entire time, in which the setting unit 144 is disposed in the third switching state, the current-limiting circuit 155 prevents the flowing of an impermissibly large short-circuit current from the terminal 5 or from the terminal 2 to the terminal connection conductor 10 by way of the simultaneously closed switches 151 and 153 or the simultaneously closed switches 150 and 152, respectively. The switch 151 is then opened as last step of the switching-over operation, whereby the setting unit passes out of the third switching state over into the first switching state.

The corresponding applies also for a switching-over operation, which leads from the first into the second switching state.

In the just described switching-over operations, the setting unit 144 passes briefly through the third switching state also always when it is to be transferred from the first into the second or from the second into the first switching state. If the setting unit 144 is to be held in the third switching state for a longer time, the switches 152 and/or 153 are opened so that no currents can any longer flow from the input terminal 2 or from the output terminal 5 to the terminal connection conductor 10 and the loss power is thus reduced still further.

In a fourth switching state, all four switches 150 to 153 are opened, so that the current circuit of the further winding 11 possesses a high resistance value which also after stepping down on the side of the first winding 9 delivers a high resistance value. Thus, a voltage drop dependent on the magnitude of the load current occurs across the first winding. This choke effect of the first winding in the fourth switching state can be used on the occurrence of a short-circuit at the load to limit the power fed to the load to an undangerous degree at least until further switching-off measures can be taken.

The switches 150 to 153 are actuated through a switch control 23, which drives the switches by way of lines 158, 159, 160 and 161. The switch control 23 can obtain the information data necessary for this from a comparator which is not reproduced in the FIG. 8 and which compares the load voltage $U_L$ and/or the supply voltage $U_V$ with target values and in the case of deviations delivers corresponding difference signals as is described in detail above. Furthermore, the transformer 8 of the setting unit 144 comprises a short-circuit winding which can be short-circuited with the aid of a switch 29, which lies in parallel with it. This switch 29, too, is driven by the switch control 23 by way of a line 30. This takes place according to the invention only when certain disturbances arise in the switches 150 to 153 or in the current-limiting circuit 157, as is described still more exactly further below.

Alternatively to the just described embodiment, the current-limiting circuit 157 can be omitted in the setting unit 144 without it having to come to the above-mentioned delays in the switching-over operation. This is attained thereby, that both the switches 152 and 153, which are then again connected directly with the terminal connection conductor 10, are each constructed as current-limiting circuit, the limit value of which can be switched to and fro between the value zero and a value different from zero. If such a current-limiting circuit is switched to the limit value zero, then this corresponds to the opened state of a switch. If it is thereagainst switched to the limit value different from zero, then it opposes the current flowing through it by only a very small constant resistance as long as this current clearly remains below the limit value. In that case, this limit value is so chosen that it is greater than the current which must in the first or in the second switching state flow through the further winding 11 and the concerned switch 153 and 152, respectively.

A circuit arrangement, which possesses the just described properties, is explained still more closely further below with reference to FIG. 10.

In the just described case, the switching-over from the first into the second switching state or from the second into the first switching state takes place in the manner that both the previously opened switches are closed simultaneously and, a short time later, both the switches are opened simultaneously, which must be opened in the new switching state. If the switches 150 and 151 are realised with the aid of triacs, then one must wait with this opening operation up to the next zero transition of the current which flows before the opening through the concerned switches 150 or 151.

In this embodiment, too, the setting unit can be brought into the fourth switching state thereby, that all four switches 150 to 153 are opened simultaneously.

Illustrated in FIG. 9 is a transformer circuit with a setting unit 174, which though it differs in build-up from that of the setting unit 144, however in principle displays the same functions.

The setting unit 174 again comprises a transformer 8, the first winding of which is connected between the input terminal 2 and the output terminal 5, whilst the other input terminal 3 is directly connected by way of the terminal connection conductor 10 in galvanically conducting manner with the other output terminal 6.

Like the setting unit 34 of FIG. 2, the transformer 8 here possesses two further windings 35 and 36, of which the one as additive further winding 35 is connected by its one end in galvanically conducting manner permanently with the end of the first winding 9, which is directly connected with the input terminal 2 in galvanically conducting manner, whilst the other end of the additive winding 35 can with the aid of a switch 180 be connected with or separated from a line 185, which in its turn is connected by way of a current-limiting circuit 157 with the terminal connection conductor 10. The other of both the windings is as subtractive further winding 36 connected by its one end permanently and directly in galvanically conducting manner with the end of the first winding 9, which is connected directly in galvanically conducting manner with the output terminal 5 of the setting unit 174, whilst the other end of the subtractive further winding 36 can with the aid of a switch 181 be connected with or separated from the line 185. The winding sense of the three windings 9, 35 and 36, which are coupled magnetically one with the other by way of the core 12, is characterised by the points 19, 20 and and 21. It is so chosen that the voltage $\Delta U_1$, which is induced in the first winding 9 through the further winding 35 when the switch 180 is closed, is added to the input voltage $U_E$ (first switching state) and that the voltage $\Delta U_2$, which is induced in the first winding 9 from the further winding 36 when the switch 181 is closed, is subtracted from the input voltage $U_E$ (second switching state). Here, too, the limit value of the current-limiting circuit 157 is chosen to be greater than the currents which respectively flow through the additive winding 35 in the first switching state and the subtractive winding 36 in the second switching state. Thus, the resistance of the current-limiting circuit 157 is practically neglible in both these switching states and the entire input voltage $U_E$ or the entire output voltage $U_A$ is present at the additive winding 35 and at the subtractive winding 36, respectively.

In order to be able to bring this setting unit, illustrated in FIG. 9, into the third switching state, it is required to close both switches 180 and 181 simultaneously, whereby both the further windings 35 and 36 are connected each in series with the other with the same winding sense and connected in parallel with the first winding with parallel and opposite winding sense. Since both the further windings 35 and 36 can in this switching state be considered as a single winding, one thus obtains the same switching state as it was described above as third switching state of the setting unit 144 of FIG. 8 and the input voltage $U_E$ is transmitted also here practically unchanged to the output of the setting unit.

In order that the input voltage $U_E$ in this third switching state is not present at the further winding 35 lying in the short-circuit and drives an impermissibly high short-circuit current from the input terminal 2 to the input terminal 3, a current-limiting circuit 157, which in principle could again be replaced by a controllable on/off switch, is provided also here again between the conductor 185 and the terminal connection conductor 10. However, for the switching-over from one switching state into the other, protection times would then again have to be introduced also here and special monitoring circuits would have to be provided in order that it is excluded with absolute certainty that the switches 180 and 181 are closed simultaneously as long as the switch connecting the lines 185 and 10 each with the other is closed. Preferably used as circuit arrangement 157 is therefore again a current-limiting circuit which automatically and without time delay prevents a further rising of the current flowing through it, when this current threatens to exceed a predetermined limit value.

The setting unit 174, too, can be brought into a fourth switching state as illustrated in the FIG. 9. In this switching state, both the switches 180 and 181 are opened at the same time, whereby a strong choke effect of the first winding again arises, which can be used to limit the short-circuit current in the case of a load short-circuit.

The switching-over from the first into the second or from the second into the first switching state takes place also here in the manner that initially that one of both the switches 180 and 181 is closed, which was open until then and that the switch closed until then is opened only thereafter. The setting unit 174 thus also here passes briefly through the third switching state during each transition from the first into the second or from the second into the first switching state.

In order that the loss power can be kept particularly small when the third switching state is to be maintained for longer times, it is provided in this embodiment that the current-limiting circuit 157 is so driven from the switch control 23 by way of two lines 163 that its limit value assumes a substantially smaller value, preferably the value zero. The current-limiting circuit 157 then acts like an opened switch and practically only the very small short-circuit current still flows, which is driven by the small voltage drop across the first winding 9 in both the further windings 35 and 36.

The switches 180 and 181 are driven from the switch control 23 by way of the lines 164 and 165.

Also the transformer 8 of the setting unit 174 displays a short-circuit winding 28, which is short-circuitable by way of a switch 29, which is driven from the switch control 23 by way of a line 30.

By reason of the build-up according to the invention, it is possible in certain cases of trouble to maintain the setting unit 174 at least partially capable of function or at least so to drive it that it delivers its input voltage unchanged at the output terminals 5 and 6. If the setting unit forms a link in a longer chain of setting units which are altogether to be used as voltage stabiliser, then at least the remaining setting units remain capable of function hereby and the entire transformer circuit can albeit to restricted extent maintain its control or regulating function. This is explained in the following for some typical cases of trouble:

1. Short-circuit in the switch 180 or 181: Such a short-circuit means that the switch concerned no longer lets itself be opened and the setting unit, if it were not constructed according to the invention, would remain permanently in the first or second switching state. If one assumes that for example the switch 180 is constantly closed, then by reason of the presence of the current-limiting circuit 157 in all the cases, in which no additive imposition of the voltage induced in the winding 9 is desired, the switch 181 can be closed and the current-limiting circuit 157 be switched to the smaller limit value. The setting unit then goes over into the third switching state and delivers the input voltage unchanged at the output. When the switch 181 is again opened and the current-limiting circuit 157 is switched back again to the greater limit value, then the setting unit again goes over into the first switching state. It can thus in spite of the trouble always still be switched to and fro between the first and the third switching state and change the amplitude of the output voltage $U_A$ in corresponding manner. The second switching state can however no longer be produced in such a case. The corresponding applies when a short-circuit occurs in the switch 181, but the switch 180 remains functionally capable. In this case, the setting unit 174 can be switched to and fro between the second and third switching state, but no longer assume the first switching state.

2. Simultaneous short-circuit in the switches 180 and 181: In this case, the current-limiting circuit 157 is switched to the lower limit value and the setting unit remains permanently in the third switching state, in which the output voltage is equal to the input voltage. It can however no longer be brought into the first or the second switching state.

3. Should a short-circuit occur simultaneously in both the switches 180 and 181 and in the current-limiting circuit 157, then a very high short-circuit current would flow initially from terminal 2 to terminal 3. For this case, a fuse 167 is connected in series with the current-limiting circuit 157, which fuse then blows and thus finally interrupts the connection between the lines 185 and 10. Because of the short-circuit in both the switches 180 and 181, the setting unit is then disposed in the third switching state.

4. Line interruption in the current-limiting circuit 157: If the current-limiting circuit 157 by reason of a trouble no longer lets any current flow, then the switches 180 and 181 are permanently closed by the switch control 23 and the setting unit 174 is permanently held in the thus resulting third switching state.

5. Line interruption in one of the switches 180 or 181: If one of both the switches 180 and 181 no longer lets itself be closed, then the above described strong choke effect of the winding 9 would occur whenever the respective other switch would have to be opened. Because of the voltage drop, which in this state arises at the choke 9, a voltage stabiliser or voltage regulator, in which a setting unit shows this trouble, would practically no longer be able to exercise its function. In order to prevent this, the short-circuit winding 28 is provided, the switch 29 of which is then closed. Thereby, the setting unit 174 is again disposed in the third switching state; it can thereby continue to be switched to and fro between the third switching state and the one of both the other operational switching states.

The just described cases of trouble can also occur in the case of the setting unit 144 illustrated in FIG. 8 and, by reason of their build-up according to the invention, be overcome in part in similar manner as was just described. Of course, a fuse 167, which lies in series with the current-limiting circuit 157, can also be provided in the setting unit 144 illustrated in FIG. 8.

Figure 10:
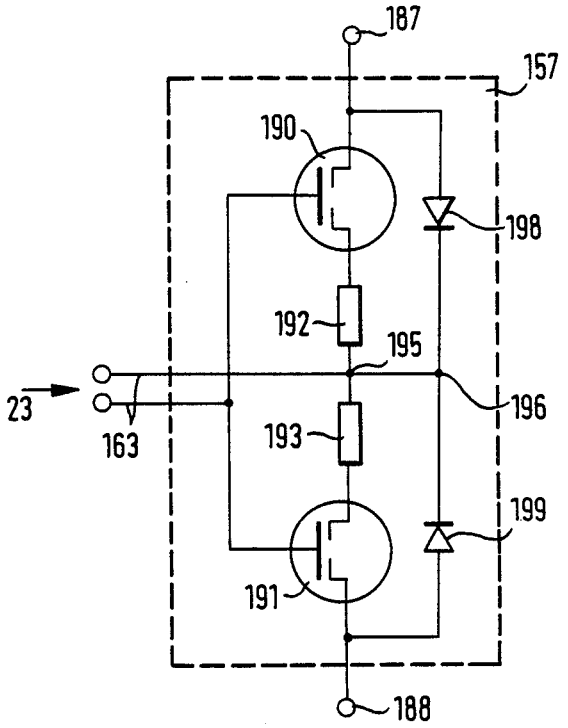

Illustrated in FIG. 10 is a current-limiting circuit 157 as it can be used in the setting units 144 and 174 in the FIGS. 8 and 9.

This current-limiting circuit possesses two current terminals 187 and 188, of which the one is directly connected in galvanically conducting manner with the line 155 or the line 185 and the other with the terminal connection conductor 10. Arranged between both the current terminals 187 and 188 is a series connection which consists of the source-drain path of a first V-MOS transistor 190, two resistors 192 and 193 and the source-drain path of a second V-MOS transistor 191. Connected in parallel with this series connection between both the current terminals 187 and 188 are two diodes 198 and 199, which lie in series each with the other and the passage directions of which are mutually opposed. The junction 196 of both the diodes 198 and 199 is connected in galvanically conducting manner with the junction 195 of both the resistors 192 and 193. Since each of both the transistors 190 and 191 possesses a diode characteristic, i.e. can unfold its blocking effect in only one direction, both the transistors 190 and 191 are so arranged that their passage directions lie parallelly to the passage direction of the diodes 198 or 199 lying in the parallel branch and are thus directed each opposite to the other. Thereby, also an alternating current can be limited in the required manner with the aid of this current-limiting circuit 157.

The diodes 198 and 199 are so selected that the voltage drop, which occurs across them when the nominal current flows, is smaller than the corresponding voltage drop across the parallel V-MOS transistor 190 and 191, respectively. Since each diode 198 or 199 bridges over not only the V-MOS transistor 190 and 191 respectively parallel thereto, but also its associated series resistor 192 and 193, respectively, the half waves of the alternating current to be limited flow either by way of the diode 198 and further by way of the resistor 193 and the V-MOS transistor 191 or by way of the diode 199 and further by way of the resistor 192 and the V-MOS transistor 190. Thereby, on the one hand, the alternating current can be limited in the required manner in each half wave by one of both the V-MOS transistors 190 and 191; on the other hand, it is avoided that the half waves must also still flow through the second resistor and the second V-MOS transistor, which are required only for the limitation of the half waves with the respective other sign. Thereby, the loss power occurring in the current-limiting circuit 157 can be kept particularly small.

The gate voltage for both the transistors 190 and 191, supplied by the switch control 23 by way of both the lines 163, is applied between the junction 195 of both the resistors 192 and 193 and both the gate terminals of the transistors 190 and 191. Hereby, the voltage, which drops across the resistors 192 and 193 on the flow of a current between the terminals 187 and 188, is subtracted from the gate voltage. The magnitude of this gate voltage is so chosen that the current, which flows from one of both the terminals 187 and 188 to the respective other terminal, can not exceed a predetermined limit value.

For the above described case, in which the current-limiting circuit 157 shall be switched to a second smaller limit value which is practically equal to zero, the gate voltage supplied by way of the lines 163 is chosen to be so small that it lies below the threshold voltage $U_{TH}$ of the V-MOS transistors 190 and 191, which thereby allow practically no current to flow any longer through their source-drain path.

As already mentioned, triacs can be used as switches 150 to 153 or 180 and 181. This means however that these switches can be opened only when the current flowing through them passes through a zero transition. It has already been pointed out that, according to the invention, on a transition from one switching state into the other, initially switches open until then are closed. Then, the setting unit 144 as well as also the setting unit 174 are each disposed in their third switching state. The respective short-circuit current then flows through the switches 150 and 151 or 152 and 153 or 180 and 181 and a transition into the succeeding first or second switching state can be made only when this short-circuit current passes through a zero transition.

If the concerned switch is then opened, the further winding 11 of one of both the further windings 35 and 36 then lies at its control voltage $U_E$ or $U_A$, which as a rule endeavours to force the flow of a current which is displaced in phase relative to the short-circuit current flowing until then, i.e. displays no zero transition in the instant, in which the respective switch is opened.

Figure 11:
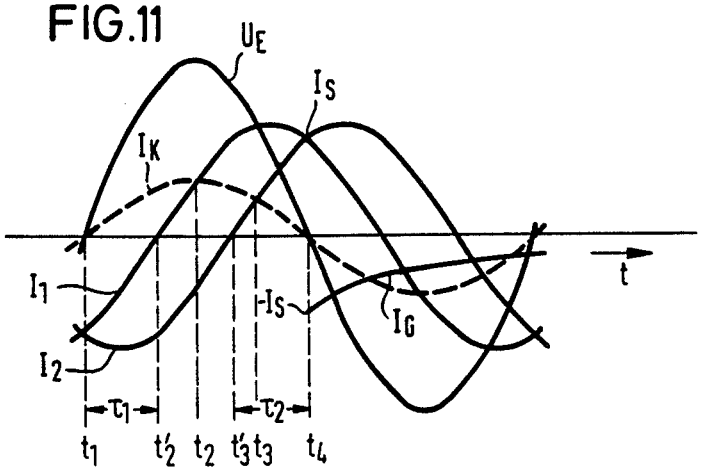

The curve course of an oscillation period of the input voltage $U_E$, of the short-circuit current $I_K$ flowing in the third switching state, of the current $I_1$ flowing in the first switching state as well as the current $I_2$ flowing in the second switching state are illustrated in a diagram in FIG. 11. In that case, the amplitude of the short-circuit current $I_K$ has been illustrated strongly enlarged for the sake of clarity.

It is expressly pointed out that the three currents $I_K$, $I_1$ and $I_2$ can not flow at the same time, since the setting unit 144 or 174 can always be disposed in only one of the three switching states.

For the following considerations, it is now to be assumed that the setting unit 144 or 174 is disposed in the third switching state, from which a transition shall be made into the first switching state during the first half period of the input voltage $U_E$ illustrated in FIG. 11, i.e. thus between the instants $t_1$ and $t_4$. For this, the switch 151 must be opened in the example of embodiment according to FIG. 1 and the switch 181 in the example of embodiment according to FIG. 9. Since these switches are flowed through by the short-circuit current $I_K$, they can be opened only in the instant $t_4$, in which the short-circuit current $I_K$ passes through a zero transition, when they are realised with the aid of triacs. It is evident from the FIG. 11 that the current $I_1$, which should immediately following the opening of the switches flow through the further winding 11 or the further winding 35, at this instant displays a value which is appreciably different from the zero transition value of the short-circuit current $I_K$, which has flowed through this further winding 11 or 35 before the opening.

It is clear that the current flowing through the further winding 11 or 35 in the new switching state can not rise in steplike manner from zero to the actually required value $I_S$. Instead thereof, a compensating current $I_G$, the value of which is initially equal to $-I_S$ and which decays exponentially over a longer time span, is induced in the transformer. It can take several oscillation periods of the input voltage $U_E$ until this compensating current $I_G$ has disappeared completely.

The compensating current $I_G$ is added to the current driven by the input voltage $U_E$ through the further winding 11 or 35. Since the transformer 8 is so dimensioned that the current, which normally flows through a further winding lying at its control voltage, lies closely below the saturation limit, the transformer is driven into saturation by this additive compensating current $I_G$. This has the consequence that a voltage trough results in the just described switching operation and leads thereto, that the transition from the old to the new voltage amplitude does not extend quite smoothly, but that voltage peaks are imposed on the first half wave of the output voltage $U_A$ following the switching operation.

In order to avoid this disturbing effect, it is provided according to the invention to build up the switches 150 to 153 and 180 and 181, instead of with triacs, likewise with V-MOS transistors, of which again two respective ones are connected each behind the other with opposite polarity. These transistors have the advantage that the switch formed by them can be opened independently of the magnitude of the current instantaneously flowing through them. Thus, the next zero transition of the short-circuit current $I_K$ no longer has to be awaited, but the transition from the third into the first or the second switching state can take place at a substantially more favourable instant.

As is evident from the FIG. 11, the optimum switch-over instants would be the instants $t_2$ and $t_3$, respectively, because the short-circuit current $I_K$, which flows in the further windings concerned before the switching-over, is in these instants equal to the current which shall flow in the respective further winding after the switching-over operation.

Since these ideal instants $t_2$ and $t_3$, respectively, are only very difficult to detect in terms of measuring technique, they can be replaced approximately by the instants $t_2'$ and $t_3'$, respectively, in which the current, which flows through the further winding in the first or in the second switching state, displays a zero transition. These substitute instants $t_2'$ and $t_3'$ are not all too far removed from the respective ideal instants $t_2$ and $t_3$. Since, as already mentioned, the amplitude of $I_K$ has been represented greatly exaggerated in FIG. 11, the current change, which is required on the use of the substitute instants $t_2'$ and $t_3'$, is also not particularly great.

Since the time spacings $\tau_1$ and $\tau_2$, which the substitute instants $t_2'$ and $t_3'$ display from the nearest zero transition of the input voltage $U_E$, are dependent on load, they can not be stored once and for all in the switch control 23. Instead thereof, they are measured whenever the setting unit 144 or 174 is disposed in the first or the second switching state and the measurement values are stored. If next time a transition shall be made from the third switching state into the first or the second switching state, then starting from the time, which has elapsed since the zero transition $t_1$ of the input voltage $U_E$, on which the switching operation shall follow, the switching instant $t_2'$ or the switching instant $t_3'$ can readily be predetermined.

Through these measures, it lets itself be attained that the output voltage of the setting unit passes through the new amplitude value in completely undisturbed manner already during the next half oscillation.

If a setting unit, which is equipped with V-MOS transistor switches and a current-limiting circuit 157 and which in the first switching state imposes a voltage change of $+\Delta U$ on its input voltage and effects a voltage change of $-\Delta U$ in the second switching state, is to be switched over from the first into the second switching state or conversely, then the voltage change of $2.\Delta U$ then occurring altogether lets itself be performed in two steps; the first step, in which the output voltage is changed by $\Delta U$, takes place at once, i.e. simultaneously with the generation of the switchover signal. This occurs thereby, that the setting unit is transferred into the third switching state through closing of one or more of the switches open until then. The second half of the required change is then managed within a time span which in the most unfavourable case is equal to half an oscillation period of the input voltage $U_E$. If one assumes that $U_E$ possesses an oscillation frequency of 50 Hertz, then the total change thus lets itself be managed within at most 10 milliseconds. Thereafter, the output voltage $U_A$ stably has its new value.

The corresponding applies also when a setting unit shall be transferred into the first or second switching state after it has been disposed in the third switching state for a longer time. Since only one or two switches need to be opened for such a transition, one must after the production of the switch-over signal merely wait until the next favourable switching instant $t_2'$ or $t_3'$ occurs. Since each of these instants stands at disposal twice in each alternating voltage period, a time duration, which corresponds to the length of half a period of the alternating voltage, must be awaited in the most unfavourable case until switching-over can be done. Although the change in the output voltage here takes place in a single step, yet the magnitude of this change is also only half as great as the total change which is passed through on the transition from the first into the second or from the second into the first switching state.

A particularly rapid and precise switching-over results when two of the above described setting units 174 are connected in series each with the other for the formation of a setting unit pair.

What is claimed is:

1. A method of generating from an alternating source voltage, which is applied to a circuit arrangement, a load voltage, which is delivered by said circuit arrangement and has a controlled amplitude, said circuit arrangement comprising at least one setting unit with two input terminals to which said alternating source voltage is applied as an alternating input voltage, two output terminals delivering an output voltage having a controllable amplitude, a transformer having a first winding with two ends a first one of which is connected to a first one of said two input terminals and the second one of which is connected to a first one of said two output terminals, and at least one further winding the number of turns of which is greater than the number of turns of said first winding, a terminal connection conductor galvanically connecting the second one of said two input terminals with the second one of said two output terminals, several controllable switches by means of which several control voltages can be selectively applied to said further winding in such a manner that in each case in said first winding a voltage is induced generating a positive or negative amplitude difference between said alternating input voltage and said alternating output voltage of said at least one setting unit, at least some of said amplitude differences being different from each other, an alternating current measuring sensor means generating measuring signals, a comparator means comparing said measuring signals which reference values, and a switch control means for selectively actuating said controllable switches of said at least one setting unit in such a manner that a deviation of said amplitude of said output voltage from a predeterminable target value never exceeds a predeterminable maximum deviation value, said method comprising the steps of choosing for said positive or negative amplitude differences a smallest absolute amplitude difference value which is greater than 1.0 times and smaller than 2.0 times said maximum deviation value, and choosing switching threshold values at which the value of the amplitude difference between said alternating input voltage and said alternating output voltage is switched from n times to (n+1) times said smallest amplitude difference value if said alternating source voltage increases, and at which the value of said amplitude difference is switched from (n+1) times to n times said smallest absolute amplitude difference value if said alternating source voltage decreases, in such a manner that the amplitude values of said alternating output voltage lie symetrically to said target value before and after actuation of the respective switches through said switch control means when said alternating supply voltage steadily exceeds or falls below one of said switching threshold values.

2. A method according to claim 1, wherein said target value is different from the nominal value of said alternating supply voltage.

3. Transformer circuit for transforming a supply voltage from a voltage source into a controllable load voltage which is to be applied to a load, wherein said transformer circuit comprises at least one setting unit comprising two input terminals to which an alternating input voltage is applied, two output terminals delivering a controllable alternating output voltage, a transformer having a first winding with two ends a first one of which is connected to a first one of said two input terminals and the second one of which is connected to a first one of said two output terminals, and a further winding which has two ends and the number of turns of which is greater than the number of turns of said first winding, a terminal connection conductor galvanically connecting the second one of said two input terminals with the second one of said two output terminals.

an alternating voltage source which is a winding of an auxiliary transformer to which, by means of a a switch arrangement, selectively either said input voltage or said output voltage of said setting unit can be applied, so that the alternating output voltage of said setting unit is either the sum of, or the difference between, said alternating input voltage and a voltage induced thereby in said first winding, respectively, said winding of said auxiliary transformer being subdivided into several winding portions between said taps are provided at which at least one smallest and several further alternating tap voltages, respectively, are tappable, said further alternating tap voltages being either equal to said smallest alternating tap voltage or equal to an integral multiple thereof, and the number of taps, between which said smallest alternating tap voltage is tappable, and the magnitudes of said further alternating tap voltages, which are equal to an integral multiple of said smallest alternating tap voltage, being so chosen that a predeterminable maximum tap voltage range is coverable in unit steps of said smallest alternating tap voltage for a minimum number of taps, several controllable switches, each of which has at least one control terminal, to which control signals can be applied for closing or opening said switch, and two switch terminals which are electrically connected with each other in the closed state and are electrically disconnected from each other in the opened state of said switch, one of said switch terminals of each of said switches being connected to one end of said further winding and the other one of said switch terminals of each of said several switches being connected to one of said taps, whereby each individual one of said tap voltages or each desired sum of such tap voltages can be selectably applied as a respective control voltage to said further winding in order to induce a smallest induced voltage or any desired integral multiple thereof in said further winding.

4. Transformer circuit according to claim 3, wherein further the maximum voltage, which is tappable at the alternating voltage source, is equal to the maximum control voltage required in order to induce a desired maximum induced voltage in said first winding.

5. Transformer circuit according to claim 4, wherein each of said tap voltages or each desired sum of such tap voltages can be applied as a respective control voltage to said further winding in either one of two possible winding senses in order to either additively or subtractively impose the respective induced voltage on said input voltage.

6. Transformer circuit according to claim 3, wherein said further winding is short-circuitable by means of said controllable switches in order to bring said setting unit into a switching state in which said alternating output voltage of said setting unit is about equal to its alternating input voltage.

7. A transformer circuit according to claim 3, further comprising an alternating voltage measuring sensor measuring said supply voltage delivered by said voltage source and generating corresponding measuring signals, a comparator arrangement comparing said measuring signals with predeterminable reference values, and a switch control by means of which the controllable switches of the stages are selectively so actuable that the amplitude of said load voltage is kept as constant as possible.

8. Transformer circuit according to claim 3, further comprising an alternating voltage measuring sensor measuring said load voltage and generating corresponding measuring signals, a comparator arrangement comparing said measuring signals with predeterminable reference values, and a switch control by means of which the controllable switches of the stages are selectively so actuable that the amplitude of said load voltage is kept as constant as possible.

9. Transformer circuit according to claim 3, wherein said transformer circuit comprises several stages each of which consists of a setting unit, the first winding of the tranformer of each setting unit lying in one of several phase conductors of a multiphase system, said transformer circuit further comprising a measuring sensor arrangement measuring the voltage on each of said phase conductors and generating corresponding measuring signals, a comparator arrangement comparing said measuring signals with at least one predeterminable reference value as well as a switch control which, on the basis of difference signals delivered by said comparator arrangement, controls the controllable switches of the stages of said transformer circuit.

10. Transformer circuit for transforming a supply voltage from a voltage source into a controlled load voltage which is to be applied to a load, wherein said transformer circuit comprises at least one setting unit comprising two input terminals to which an alternating input voltage is applied, two output terminals delivering a controllable alternating output voltage, a transformer having a first winding with two ends a first one of which is connected to a first one of said two input terminals and the second one of which is connected to a first one of said two output terminals, and two further windings each of which has two ends, and the number of turns of each of which is greater than the number of turns of said first winding, a terminal connection conductor galvanically connecting the second one of said two input terminals with the second one of said two output terminals, a first and a second controllable switch, each of which has at least one control terminal to which control signals can be applied for closing or opening said switch, and two switch terminals which are electrically connected with each other in the closed state and are electrically disconnected from each other in the opened state of said switch, a first current path to which an alternating control voltage is applied and which leads from a first end of a first one of said two further windings to the other end thereof, therefrom through said first controllable switch from one to the other of its switch terminals, and therefrom to a conductor, said alternating control voltage being applied between said first end of said first further winding and said conductor, a second current path to which an alternating control voltage is applied and which leads from a first end of the second one of said two further windings to the other end thereof, therefrom through said second controllable switch from one to the other of its switch terminals, and therefrom to a conductor, said alternating control voltage being applied between said first end of said second further winding and said conductor, each of said two current paths including a current-limiting circuit having a small electrical resistance for as long as the current flowing through it is smaller than a predetermined limit value and having a high electrical resistance if the current flowing through it is greater than said limit value, whereby said setting unit can be brought, into a first switching state in which said second switch is open and said first switch is closed so that said alternating control voltage, which is applied to said first current path, is applied to said first one of said two further windings with such a winding sense that the alternating output voltage of said setting unit is the sum of a voltage induced hereby in said first winding and said alternating input voltage, and a second switching state in which said first switch is open and said second switch is closed so that said alternating control voltage, which is applied to said second current path, is applied to said second one of said two further windings with such a winding sense that the alternating output voltage of said setting unit is the difference between said alternating input voltage and a voltage induced hereby in said first winding, and wherein said transformer circuit further comprises a switch control means controlling said two controllable switches in such a manner that for switching over from said first to said second switching state and for switching over from said second to said first switching state always the previously open switch is closed before the previously closed switch is opened.

11. Transformer circuit according to claim 10, wherein two further controllable switches are provided each of which is electrically connected in parallel with its, switch terminals to one of said two further windings, whereby said setting unit can be brought into a third switching state by closing said two further switches, in which third switching state each of said two further windings is electrically short-circuited causing said alternating output voltage of said setting unit to be about equal to its alternating input voltage.

12. Transformer circuit according to claim 10, wherein the end of said first further winding, which end is not connected to a switch terminal of said first controllable switch, is connected to said first end of said first winding, and wherein the end of said second further winding, which end is not connected to a switch terminal of said second controllable switch, is connected to said second end of said first winding, and wherein the switch terminals of said two controllable switches, which terminals are not connected to the respective one of said further windings, are directly in a galvanically conducting manner connected each with the other by means of an electrical conductor, whereby said setting unit can be brought into a third switching state by simultaneously closing said first and said second controllable switch, in which third switching state said two further windings are electrically connected in series each to the other and together in parallel to said first winding, causing said alternating output voltage of said setting unit to be about equal to its alternating input voltage.

13. Transformer circuit according to claim 12, wherein said controllable switches are so controlled by said switch control means that, for switching over from said first switching state to said second switching state initially said second switch is closed and then said first switch is opened and that for switching over from said second switching state to said first switching state initially said first switch is closed and then said second switch is opened, whereby for each transition from said first into said second switching state and from said second into said first switching state said setting unit is first brought into said third and then into said second or said first switching state, respectively.

14. Transformer circuit according to claim 12, wherein said electrical conductor, which connects directly in a galvanically conducting manner two switch terminals of said two controllable switches, is electrically connected to said current limiting circuit, which, in this case, is common to both of said current paths.

15. Transformer circuit according to claim 10 or 12, wherein each of said two controllable switches is designed to also operate as a current-limiting circuit.

16. Transformer circuit for transforming a supply voltage from a voltage source into a controllable load voltage which is to be applied to a load, wherein said transformer circuit comprises at least one setting unit comprising two input terminals to which an alternating input voltage is applied, two output terminals delivering a controllable alternating output voltage, a transformer having a first winding with two ends a first one of which is connected to a first one of said two input terminals and the second one of which is connected to a first one of said two output terminals, and a further winding which has two ends and the number of turns of which is greater than the number of turns of said first winding, a terminal connection conductor galvanically connecting the second one of said two input terminals with the second one of said two output terminals, a first, a second, a third and a fourth controllable switch, each of which has at least one control terminal, to which control signals can be applied for closing or opening said switch, and two switch terminals which are electrically connected with each other in the closed state and are electrically disconnected from each other in the opened state of said switch, a first current path to which an alternating control voltage is applied and which leads from a first one of the switch terminals of said first switch to the second one of its switch terminals, therefrom through said further winding from a first one to the second one of its ends, therefrom through said fourth switch from one to the other of its switch terminals, and therefrom to a conductor, said alternating control voltage being applied between said first switch terminal of said first switch and said conductor, a second current path to which an alternating control voltage is applied and which leads from a first one of the switch terminals of said second switch to the second one of its switch terminals, therefrom through said further winding from said second one to said first one of its ends, therefrom through said third switch from one to the other of its switch terminals, and therefrom to a conductor, said alternating control voltage being applied between said first switch terminal of said second switch and said conductor, each of said two current paths including a current-limiting circuit having a small electrical resistance for as long as the current flowing through it is smaller than a predetermined limit value and having a high electrical resistance if the current flowing through it is greater than said limit value, whereby said setting unit can be brought into a first switching state in which said second and said third switch are open and said first and said fourth switch are closed so that said alternating control voltage, which is applied to said first current path, is applied to said further winding with a winding sense such that the alternating output voltage of said setting unit is the sum of a voltage induced hereby in said first winding and said alternating input voltage, and a second switching state in which said first and said fourth switch are open and said second and said third switch are closed so that said alternating control voltage, which is applied to said second current path, is applied to said further winding with a winding sense such that the alternating output voltage of said setting unit is the difference between said alternating input voltage and a voltage induced hereby in said first winding, and wherein said transformer circuit further comprises a switch control means controlling said four switches in such a manner that for switching over from said first to said second switching state and for switching over from said second to said first switching state always at least one of the previously open switches is closed before the first one of the previously closed switches is opened.

17. Transformer circuit according to claim 16, wherein a further controllable switch is provided which is electrically connected in parallel with its switch terminals to said further winding, whereby said setting unit can be brought into a third switching state by closing said further switch, in which third switching state said further winding is electrically short-circuited causing said alternating output voltage of said setting unit to be about equal to its alternating input voltage.

18. Transformer circuit according to claims 16 or 17, wherein said setting unit further comprises a sensor means generating an output signal which represents the magnetic flux in said first winding and wherein, for switching over from said first to said second switching state or from said second to said first switching state, the respective control signals for closing the respective previously opened controllable switches are generated in dependence on the output signal of said sensor means in such a manner that the closing of the respective switch causes a smallest possible change in said magnetic flux, and the previously closed controllable switches are opened only at the zero transition of the current flowing through the respective further winding.

19. Transformer circuit according to claim 18, wherein said transformer further comprises a short-circuit winding to which a controllable switch with its switch terminals is connected in parallel.

20. Transformer circuit according to claim 16, wherein the switch terminal of said first controllable switch, which terminal is not connected to said further winding, is connected to said first end of said first winding and wherein the switch terminal of said second controllable switch, which terminal is not connected to said further winding, is connected to said second end of said first winding, whereby said setting unit can be brought into a third switching state by simultaneously closing said first and said second controllable switch in which third switching state said further winding is electrically connected in parallel to said first winding causing said alternating output voltage of said setting unit to be about equal to its alternating input voltage.

21. Transformer circuit according to claim 20, wherein the switch terminals of said third and fourth controllable switches, which terminals are not electrically connected with said further winding, are directly and in a galvanically conducting manner connected each with the other by means of an electrical conductor which is electrically connected to said current-limiting current which, in this case, is common to both of said current paths, and wherein the further current path which connects both the ends of said further winding with each other when said third and fourth controllable switches are closed at the same time, possesses an electrical resistance value which is greater than the ohmic resistance of said further winding.

22. Transformer circuit according to claim 21, wherein said controllable switches are so controlled by said switch control means that, for switching over from said first switching state to said second switching state initially said second switch is closed, then said fourth switch is opened, then said third switch is closed, and then said first switch is opened, and that, for switching over from said second to said first switching state, initially said first switch is closed, then said third switch is opened, then said fourth switch is closed and then said second switch is opened, whereby for each transition from said first into said second switching state and from said second into said first switching state said setting unit is first brought into said third and then into said second or said first switching state, respectively.

23. Transformer circuit according to claim 21, wherein said controllable switches are so controlled by said switch control means that for switching over from said first switching state to said second switching state initially said second and said third switch are closed and then said first and said fourth switch are opened and that, for switching over from said second to said first switching state, initially said first and said fourth switch are closed and then said second and said third switch are opened, whereby for each transition from said first into said second switching state and from said second into said first switching state said setting unit is first brought into said third and then into said second or said first switching state, respectively.

24. Transformer circuit according to claim 12 or 20, wherein said controllable switches are electronic switches, which can be opened and closed at any desired instants, and wherein said switches which must be opened for switching-over said setting unit from said third to said first or to said second switching state, are opened as accurately as possible in instants, in which the current flowing in said third switching state through said further winding, to which after said switching-over a control voltage is applied, has the same value as the current flowing in this further winding immediately after this respective switching-over operation.

25. Transformer circuit according to claim 12 or 20, wherein said controllable switches are electronic switches, which can be opened and closed at any desired instants and wherein said switches, which must be opened for switching-over said setting unit from said third to said first or second switching state, are opened in instants, in which the current, which in said first or said second switching state flows through said further winding to which in this switching state a control voltage is applied, has a zero transistion.

26. Transformer circuit according to claim 12 or 20, wherein said controllable switches are electronic switches, which can be opened and closed at any desired instants, wherein said switches, which must be opened for switching-over said setting unit from said third to said first or second switching state, are opened in instants, in which the current, which in said first or said second switching state flows through said further winding, to which in this switching state a control voltage is applied, has a zero transition, wherein the time interval between a zero transition of the current, which in said first or said second switching state flows through the further winding to which in this switching state a control voltage is applied, and the preceding or the succeeding zero transistion of this control voltage is measured in order to obtain a measurement value which is stored, and wherein said stored measurement value is used later for switching-over from said third into said first or said second switching state in order to determine the instant for opening the switches concerned.

27. Transformer circuit according to claims 12 or 20, wherein said limit value for said current-limiting circuit is chosen to be somewhat greater than the current which flows through the respective further winding to which said alternating control voltage is applied in said first or said second switching state of said setting unit, and wherein, for longer time spans during which said setting unit is held in said third switching state, said current-limiting circuit is switchable to a second limit value being substantially smaller than said first limit value.

28. Transformer circuit according to claims 12 or 20, wherein said limit value for said current-limiting circuit is chosen to be somewhat greater than the current which flows through the respective further winding to which said alternating control voltage is applied in said first or said second switching state of said setting unit, and wherein, for longer time spans during which said setting unit is held in said third switching state, said current limiting circuit is switchable to a second limit value which is equal to zero.

29. Transformer circuit according to claims 12 or 20, wherein said current-limiting circuit, on approaching to said limit value, regulates the current flowing through it so that a steady transition to said limit value takes place.

30. Transformer circuit according to claims 12 or 20, wherein said current-limiting circuit comprises a first current terminal, a first V-MOS transistor having a gate terminal and two source-drain terminals, one of which is connected to said first current terminal and the other one of which is connected to a first resistor, a second current terminal, a second V-MOS transistor having a gate terminal and two source-drain terminals, one of which is connected to said second current terminal and the other one of which is connected to a second resistor, the other ends of each of said two resistors being connected to each other at a connection point and said two V-MOS transistors being arranged with mutually opposite polarity, a first diode being connected with said first current terminal and said connection point between said two resistors, the forward direction of said first diode being the same as the permenent forward direction of said first V-MOS transistor, a second diode being connected with said second current terminal and said connection point between said two resistors, the forward direction of said second diode being the same as the permanent forward direction of said second V-MOS transistor, and two control terminals to which a gate voltage for said two V-MOS transistors is applied, one of said control terminals being connected to said gate terminals of said two V-MOS transistors, and the other one of said control terminals being connected to said connection point between said two resistors.

31. Transformer circuit according to claim 16 or 20, wherein in each of said first and second current paths one of the controllable switches is designed also to operate as a current-limiting circuit.

32. Transformer circuit according to claim 10 or 16, wherein said transformer circuit comprises at least two stages, each of which consists of at least one setting unit, which stages are so connected each in series with the other that the alternating output voltage of one of said stages is the alternating input voltage for the other one of said stages, and that the first windings of the transformers of the at least two stages lie each directly in series with the other.

33. Transformer circuit according to claim 32, further comprising an alternating voltage measuring sensor measuring said supply voltage delivered by said voltage source and generating corresponding measuring signals, a comparator arrangement comparing said measuring signals with predeterminable referencee values, and a switch control by means of which the controllable switches of the stages are selectively so actuable that the amplitude of said load voltage is kept as constant as possible.

34. Transformer circuit according to claim 32, further comprising an alternating voltage measuring sensor measuring said load voltage and generating corresponding measuring signals, a comparator arrangement comparing said measuring signals with predeterminable reference values, and a switch control by means of which the controllable switches of the stages are selectively so actuable that the amplitude of said load voltage is kept as constant as possible.

35. Transformer circuit according to claim 32, wherein each stage comprises two setting units, which form a setting unit pair by matching the turns ratios of the first winding of each of said two setting units to the associated further windings in such a manner that the alternating output voltage of the setting unit pair is equal to the alternating input voltage of the setting unit pair when one of the setting units is in said first switching state and the other setting unit is in said second switching state.

36. Transformer circuit according to claim 35, wherein the ratios of the absolute values of the amplitude differences producable by the different states are 1:3:9 and so forth.

37. Transformer circuit according to claims 10 or 16, wherein said alternating control voltage, which is applied to said first current path, is said alternating input voltage of said setting unit, and wherein said alternating control voltage, which is applied to said second current path; is said alternating, output voltage of said setting unit.

38. Transformer circuit according to claim 10 or 16, wherein said transformer circuit comprises several stages each of which consists of two setting units, which are so connected each in series with the other that the alternating output voltage of one of said setting units is the alternating input voltage for the other one of said setting units and that the first windings of the transformers of the two setting units lie each directly in series with the other in one or several phase conductors of a multiphase system, said transformer circuit further comprising a measuring sensor arrangement measuring the voltage on each of said phase conductors and generating corresponding measuring signals, a comparator arrangement comparing said measuring signals with at least one predeterminable reference value as well as a switch control which, on the basis of difference signals delivered by said comparator arrangement, controls the controllable switches of the stages of said transformer circuit.

39. Transformer circuit according to claim 3 or 10 or 16, comprising several stages, each of which consists of at least one setting unit the first winding of which lies in one of several phase conductors of a multiphase system having no neutral conductor, the terminal connection conductors of all setting units being connected one with the other thereby forming an artificial neutral conductor.

40. Transformer circuit according to claim 3 or 10 or 16, comprising several stages each of which consists of at least one setting unit the first winding of which lies in one of several phase conductors of a multiphase system having no neutral conductor, the terminal connection conductors of said setting units being formed by one of the other phase conductors so that the setting units belonging to different phase conductors are arranged in interlinked connection.

41. Transformer circuit according to claim 3 or 10 or 16, comprising several stages each of which consists of at least one setting unit the first winding of which lies in one of several phase conductors of a multiphase system having a neutral conductor, and the terminal connection conductor of which is connected with the neutral conductor of the multiphase system.

* * * * *